US008210133B2

(12) United States Patent
Hirose et al.

(10) Patent No.: US 8,210,133 B2
(45) Date of Patent: Jul. 3, 2012

(54) ENGINE-DRIVEN POWER GENERATOR APPARATUS

(75) Inventors: Tadafumi Hirose, Wako (JP); Hitoshi Yuki, Wako (JP); Takayuki Aoki, Wako (JP); Ryosuke Shibata, Wako (JP); Hiroki Iikura, Wako (JP); Makoto Uchimi, Wako (JP); Masashi Kai, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 473 days.

(21) Appl. No.: 12/485,276

(22) Filed: Jun. 16, 2009

(65) Prior Publication Data

US 2009/0320772 A1 Dec. 31, 2009

(30) Foreign Application Priority Data

Jun. 27, 2008 (JP) ..... 2008-168760
Jun. 27, 2008 (JP) ..... 2008-169070
Jun. 27, 2008 (JP) ..... 2008-169114

(51) Int. Cl.
*F02B 63/00* (2006.01)
*F01P 7/04* (2006.01)

(52) U.S. Cl. ... 123/41.56; 123/2; 123/41.65; 123/198 E; 290/1 B

(58) Field of Classification Search ..... 123/2, 195 C, 123/198 E, 41.57, 41.62–41.7; 290/1 A, 290/1 B See application file for complete search history.

(56) References Cited

U.S. PATENT DOCUMENTS 4,835,405 A * 5/1989 Clancey et al. ..... 290/1 A
4,964,378 A * 10/1990 Tamba et al. ..... 123/41.57
2007/0126235 A1 6/2007 Xiao
2008/0048510 A1 2/2008 Onodera et al.
2008/0252080 A1 10/2008 Xiao

FOREIGN PATENT DOCUMENTS

EP 1707776 A1 10/2006
EP 1736648 A1 12/2006
JP 49-110108 U 9/1974
JP 60-15918 U 2/1985
JP 11-200861 A 7/1999
JP 11-318002 A 11/1999
JP 2000-134720 A 5/2000

OTHER PUBLICATIONS

European Search Report dated Sep. 18, 2009, issued in corresponding European Patent Application No. 09163625.
Japanese Office Action dated Jan. 10, 2012, issued in corresponding Japanese Patent Application No. 2008-169114.

* cited by examiner

*Primary Examiner* — Noah Kamen
(74) *Attorney, Agent, or Firm* — Westerman, Hattori, Daniels & Adrian, LLP

(57) ABSTRACT

Engine cooling structure directs cooling air, introduced into a case by operation of a fan, to a cylinder block of an engine and then discharges the cooling air out of the case through an outlet port along meandering flow passages. Case cooling structure directs cooling along the inner surface of the case. Further cooling flow passage directs the air to vertically-oriented heat radiating fins so that the cooling air flows upward along the fins and then is discharged through the outlet port. Metal cooling-fan cover is supported by the lower cover via mounting members, and a resin-made cover guide is fastened to the engine together with supporting portions and interposed between the fan cover and the engine.

6 Claims, 17 Drawing Sheets

ENGINE-DRIVEN POWER GENERATOR APPARATUS

FIELD OF THE INVENTION

The present invention relates to engine-driven power generator apparatus where an engine-driven power generator is accommodated in a case together with the engine, and where the engine is fixedly supported by a lower cover via mounting members.

BACKGROUND OF THE INVENTION

Small-size engine-driven power generator apparatus have been known which include an engine for driving a power generator and a cooling fan connected to a drive shaft of the engine, and in which the engine and cooling fan are accommodated in a case and the case has an external air inlet port and a cooling air outlet port. One example of such small-size engine-driven power generator apparatus is disclosed in Japanese Patent Application Laid-Open Publication No. HEI-11-200861 (JP H11-200861 A).

With the engine-driven power generator apparatus disclosed in JP H11-200861 A, operation of the cooling fan can introduce external air into the case through the external air inlet port so that the introduced external air is directed into a shroud of the engine as cooling air to cool the engine. The cooling air having cooled the engine is then sent from the shroud to the cooling air outlet port, through which it is discharged to outside the case.

Further, as the displacement of the engine increases, air suction and exhaust sound (or noise) increases. Thus, if the engine of the power generator apparatus is of a great displacement, it is necessary to provide a sound absorbing material on the inner surface of the case so as to suppress the air suction and exhaust sound of the engine.

However, providing the sound absorbing material on the inner surface of the case would increase the number of necessary component parts and thus increase the weight of the engine-driven power generator apparatus. Further, because providing the sound absorbing material on the inner surface of the case requires an extra space therefor within the case, the size of the engine-driven power generator apparatus would increase. Consequently, it has heretofore been difficult to reduce the weight and size of the engine-driven power generator apparatus. In addition, the increased weight and size of the engine-driven power generator apparatus would impair the mobility and portability of the engine-driven power generator apparatus.

Furthermore, with the engine-driven power generator apparatus disclosed in JP H11-200861 A, which is constructed to direct external air, introduced into the case, to the engine as cooling air to cool the engine, it was difficult to lower the temperature of the case by the cooling air flowing along the inner surface of the case.

Furthermore, in the engine-driven power generator apparatus disclosed in JP H11-200861 A, the entire engine, including its bottom portion, is surrounded by the shroud, so that the cooling air can be efficiently directed, via the shroud, to and along the bottom portion of the engine. Thus, the cooling air can cool the bottom portion of the engine to thereby efficiently cool the engine.

However, in order to direct the cooling air to and along the bottom portion of the engine, the engine-driven power generator apparatus disclosed in JP H11-200861 A necessitates the provision of the shroud surrounding the entire engine.

Consequently, the shroud has to have a large size, which would increase the weight of the power generator apparatus. Further, the disclosed engine-driven power generator apparatus requires a large installation space for the shroud, which would increase the size of the power generator apparatus. Due to the increased weight and size, the mobility and portability of the disclosed engine-driven power generator apparatus would be impaired.

Another example of the engine-driven power generator apparatus is disclosed, for example, in Japanese Patent Application Laid-Open Publication No. 2000-328957 (JP 2000-328957 A), where the cooling fan and power generator are connected to the drive shaft of the engine and covered with a metal cooling fan cover that is fixedly supported by the lower cover via mounting members. The engine-driven power generator apparatus disclosed in JP 2000-328957 A can efficiently direct the cooling air, sent from the cooling fan, to the engine by means of the cooling fan cover and cool the engine with the thus-directed cooling air.

However, with the engine-driven power generator apparatus disclosed in JP 2000-328957 A, where the cooling fan cover is fixedly supported by the lower cover via the mounting members, it is necessary to support the weights of the engine and power generator by the cooling fan cover. Thus, the cooling fan cover must have a high rigidity, and this is why the cooling fan cover is made of metal. But, because the metal cooling fan cover is relatively heavy in weight, it has heretofore been difficult to reduce the weight of the engine-driven power generator apparatus.

SUMMARY OF THE INVENTION

In view of the foregoing prior art problems, it is an object of the present invention to provide an improved engine-driven power generator apparatus which can effectively suppress air suction and exhaust sound of the engine and lower the temperature of the case without impairing its mobility and portability.

It is another object of the present invention to provide an improved engine-driven power generator apparatus which can cool the engine with an enhanced cooling efficiency without impairing its mobility and portability.

It is still another object of the present invention to provide an improved engine-driven power generator apparatus which not only can cool the engine with an enhanced efficiency but also can be reduced in weight.

In order to accomplish the above-mentioned objects, the present invention provides an improved engine-driven power generator apparatus, which comprises: a power generator; an engine for driving the power generator; a cooling fan connected to a drive shaft of the engine; a lower cover supporting the engine; a case disposed over the lower cover and having the engine and the cooling fan accommodated therein; a first cooling structure for directing cooling air, introduced into the case by operation of the cooling fan, to a cylinder block of the engine to cool the cylinder block and then discharging the cooling air, having cooled the cylinder block, out of the case along meandering flow passages; and a second cooling structure for directing cooling air, introduced into the case by the operation of the cooling fan, along the inner surface of the case to cool the case.

Because the first cooling structure is constructed to discharge the cooling air, having cooled the cylinder block, out of the case along the meandering flow passages, the present invention can prevent air suction and exhaust sound (or noise) of the engine from easily leaking out of the outlet port along with the cooling air, so that it can effectively reduce undesired air suction and exhaust sound without providing a particular sound absorbing member on the inner surface of the case. Thus, there is no need to secure a space for providing the sound absorbing material, so that the engine-driven power generator apparatus of the present invention can be constructed in a compact or reduced size. As a result, it is possible to reduce suction and exhaust sound of the engine without impairing the mobility and portability of the power generator apparatus.

Further, because the second cooling structure is constructed to direct cooling air, introduced into the case, along the inner surface of the case, the cooling air is allowed to flow smoothly along the inner surface of the case. As a result, the present invention can reliably prevent heat of the engine from undesirably staying near the inner surface of the case and thus can effectively lower the temperature of the case.

Preferably, the case is formed in a substantially rectangular parallelepiped shape with left and right side wall portions and front and rear wall portions, and the cooling fan is disposed in opposed relation to one of the left and right side wall portions. The first cooling structure includes a first inlet port provided in one of the front and rear wall portions for introducing therethrough the cooling air into the case, a first cooling flow passage section for cooling the cylinder block with the introduced cooling air, and an outlet port provided in other of the front and rear wall portions for discharging therethrough the cooling air having cooled the cylinder block. The second cooling structure includes a second inlet port provided in the lower cover for introducing therethrough cooling air into the case along the inner surface of the case, and a second cooling flow passage section for cooling the case with the cooling air introduced through the second inlet port and discharging the cooling air, having cooled the case, through the outlet port.

The cooling fan is disposed in opposed relation to one of the left and right side wall portions, and the first inlet port is provided in one of the front and rear wall portions. Namely, the first inlet port is disposed adjacent to one side of the cooling fan, and the outlet port is provided in the other of the front and rear wall portions.

The cooling air sucked in through the first inlet port is directed meanderingly or curvingly toward the front surface of the cooling fan so that the thus-directed cooling air cools the engine. The cooling air having cooled the engine is directed toward the outlet port via the other side wall portion. Thus, the cooling air having cooled the engine is directed meanderingly to the outlet port to be discharged therethrough. Because the cooling air is discharged after having flown meanderingly through the case in the aforementioned manner, the present invention can prevent air suction and exhaust sound (or noise) of the engine from easily leaking out of the outlet port along with the cooling air, so that it can effectively reduce the air suction and exhaust sound. Further, with the second inlet port of the second cooling structure provided in the lower cover for introducing therethrough cooling air into the case along the inner surface of the case, the cooling air is allowed to flow smoothly along the inner surface of the case, which can prevent heat of the engine from undesirably staying near the inner surface of the case and thus can efficiently lower the temperature of the case.

Preferably, the first cooling structure includes a cylinder cooling flow passage defined by an engine shroud provided over the cylinder block for directing the cooling air to the cylinder block, and the second cooling structure includes a case cooling flow passage defined by a case shroud provided with a predetermined interval from the inner surface of the case for directing the cooling air along the inner surface of the case. With the case cooling flow passage, the cooling air can flow reliably and smoothly along the inner surface of the case and thus can effectively lower the temperature of the case.

In an embodiment, the engine-driven power generator apparatus further comprises: a heat radiating fin provided in a vertical orientation on a wall portion of a crankcase of the engine opposite from the cooling fan; and a further cooling flow passage defined by the lower cover and the crankcase for directing the cooling air to the heat radiating fin so that the cooling air flows upward along the heat radiating fin and then is discharged through the outlet port.

The bottom portion of the crankcase can be efficiently cooled by the cooling air directed thereto via the further cooling flow passage. Further, with the heat radiating fin provided in a vertical orientation on the crankcase, the cooling air directed to the heat radiating fin via the further cooling flow passage can smoothly flow upward along the heat radiating fin and thereby cool the wall portion of the crankcase, after which the cooling air can be efficiently discharged through the outlet port. Thus, the engine can be cooled with an enhanced efficiency by the cooling air, directed to the further cooling flow passage, efficiently cooling the bottom portion of the crankcase and by the cooling air, directed to the heat radiating fin, efficiently cooling the wall portion of the crankcase.

Further, with the further cooling flow passage defined by the lower cover and the crankcase, the lower cover can function also as part of the further cooling flow passage, and thus, the present invention can eliminate the need for a large-size shroud and hence large installation space therefor as required in the prior art counterpart. As a result, the engine-driven power generator apparatus of the present invention can be significantly reduced in weight and size and can present an enhanced mobility and portability.

Preferably, the further cooling flow passage includes a vertically-projecting guide section for directing the cooling air upward to the heat radiating fin along the crankcase. Thus, the vertically-projecting guide section can efficiently direct the cooling air along the crankcase cooling air to thereby cool the engine with an even further enhanced efficiency.

In an embodiment, the engine is fixedly supported by the lower cover via a mounting member, and the engine-driven power generator apparatus of the present invention further comprises: a metal fan cover covering the cooling fan and supported by the lower cover via the mounting member; a plurality of supporting leg portions provided on the fan cover and extending from the fan cover to the engine; and a resin-made cover guide fastened to the engine together with the plurality of supporting leg portions and interposed between the fan cover and the engine, the cover guide directing the cooling air, sent from the cooling fan, toward the engine.

With the cooling fan covered with the metal fan cover and the resin-made cover guide fastened to the engine together with the plurality of supporting leg portions and interposed between the fan cover and the engine, the cooling air sent from the cooling fan can be efficiently directed to the engine via the fan cover and cover guide and thereby cool the engine with an even further enhanced efficiency.

Further, with the metal fan cover supported by the lower cover via the mounting member, the weights of the engine and power generator can be supported by the supporting leg portions and metal fan cover rather than by the resin-made cover guide. Because it is not necessary to support the weights of the engine and power generator by the resin-made cover guide, the cover guide can present a sufficient rigidity even if it is formed of resin. With the resin-made cover guide interposed between the metal fan cover and the engine, the engine-driven power generator apparatus of the present invention can be reduced in weight.

Preferably, the engine-driven power generator apparatus of the present invention further comprises an elastic sealing member provided on and along the outer periphery of the resin-made cover guide for preventing the cooling air, having been directed from the cover guide to the engine, from flowing back from the engine toward the cover guide. Thus, the cooling air sent from the cooling fan can be even more efficiently directed to the engine to thereby cool the engine with an even further enhanced efficiency.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

In the following description, the terms "forward" and "front" refer to a direction in which a human operator pulls an engine-driven power generator apparatus 10 of the present invention via a pulling handle 125.

Figure 1:
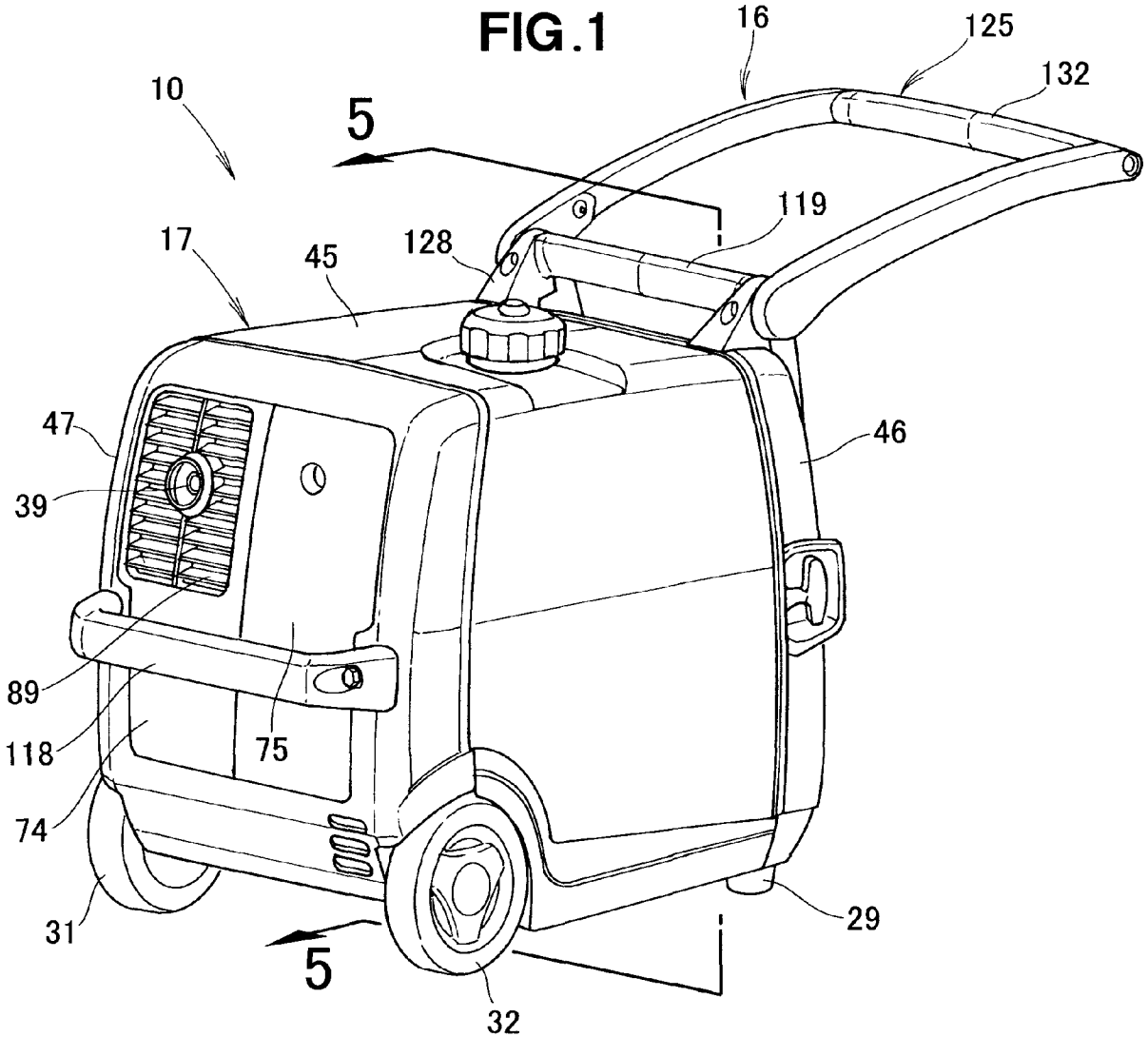
FIG. 1 is a perspective view showing an embodiment of an engine-driven power generator apparatus of the present invention.
Figure 2:
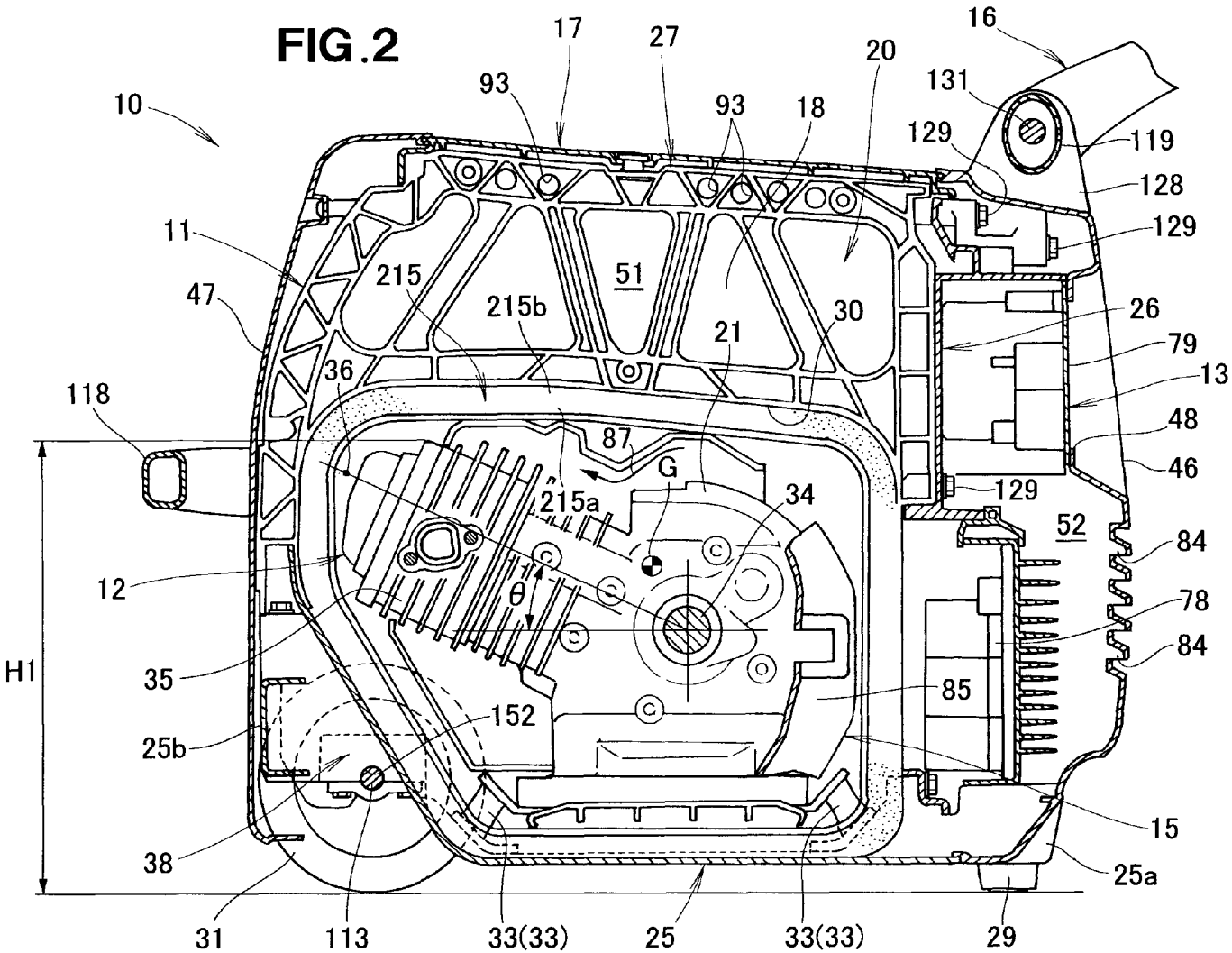
FIG. 2 is a sectional view of the engine-driven power generator apparatus.

FIG. 1 is a perspective view showing an embodiment of the engine-driven power generator apparatus 10 of the present invention, and FIG. 2 is a sectional view of the engine-driven power generator apparatus of the present invention. The engine-driven power generator apparatus 10 includes: a framework unit 11 forming the body of the power generator apparatus 10; an engine/power generator unit 12 comprising an engine 21 and a power generator 22 drivable by the engine 21; an electric component section 13 for controlling the output of the engine/power generator unit 12; an air intake/fuel supply mechanism 14 (see FIG. 5) for supplying fuel to the engine/power generator unit 12; a cooling structure 15 for directing cooling air to the engine/power generator unit 12; a carrying structure 16 for carrying the engine-driven power generator apparatus 10; a case 17 covering the engine/power generator unit 12 and electric component section 13; a heat insulating member 18 partitioning an accommodating space 20 in the case 17; and a muffler 23 (see FIG. 5) provided on the engine 21 of the engine/power generator unit 12; and a vibration suppression section 28 for suppressing vibration of the engine/power generator unit 12 (see FIGS. 9 and 11).

The engine-driven power generator apparatus 10 also includes left and right leg portions 29 provided on a front end (one end) region 25*a* of a lower cover 25 of the framework unit 11, and left and right wheels 31 and 32 provided on a rear end region 25*b* of the lower cover 25. The left and right leg portions 29 are formed of rubber. With the left and right leg portions 29 and left and right wheels 31 and 32 contacting the ground surface, the lower cover 25 can be held in a substantially horizontal orientation.

Further, in the engine-driven power generator apparatus 10, the engine/power generator unit 12 is fixedly mounted to, or supported by, the lower cover 25 of the framework unit 11 via four mounting members 33. The power generator 22 is connected to a drive shaft (crankshaft) 34 of the engine 21 (see FIG. 5).

The engine 21 has a cylinder block 35 inclined by an angle θ about the axis of the drive shaft (crankshaft) 34 downward toward an axle 113 (FIG. 2) supporting the left and right wheels 31 and 32. Reference numeral 36 indicates a centerline of the cylinder block 35.

With the cylinder block 35 inclined downward at the angle θ as noted above, the engine 21 has a reduced height H1, which can reduce the overall height and size of the engine-driven power generator apparatus 10. Further, with the cylinder block 35 inclined downward by the angle θ, a wheel accommodating space 38 is secured beneath the cylinder block 35, so that the left and right wheels 31 and 32 are disposed in the accommodating space 38. With the left and right wheels 31 and 32 disposed in the accommodating space 38, it is possible to even further reduce the size of the engine-driven power generator apparatus 10.

Figure 3:
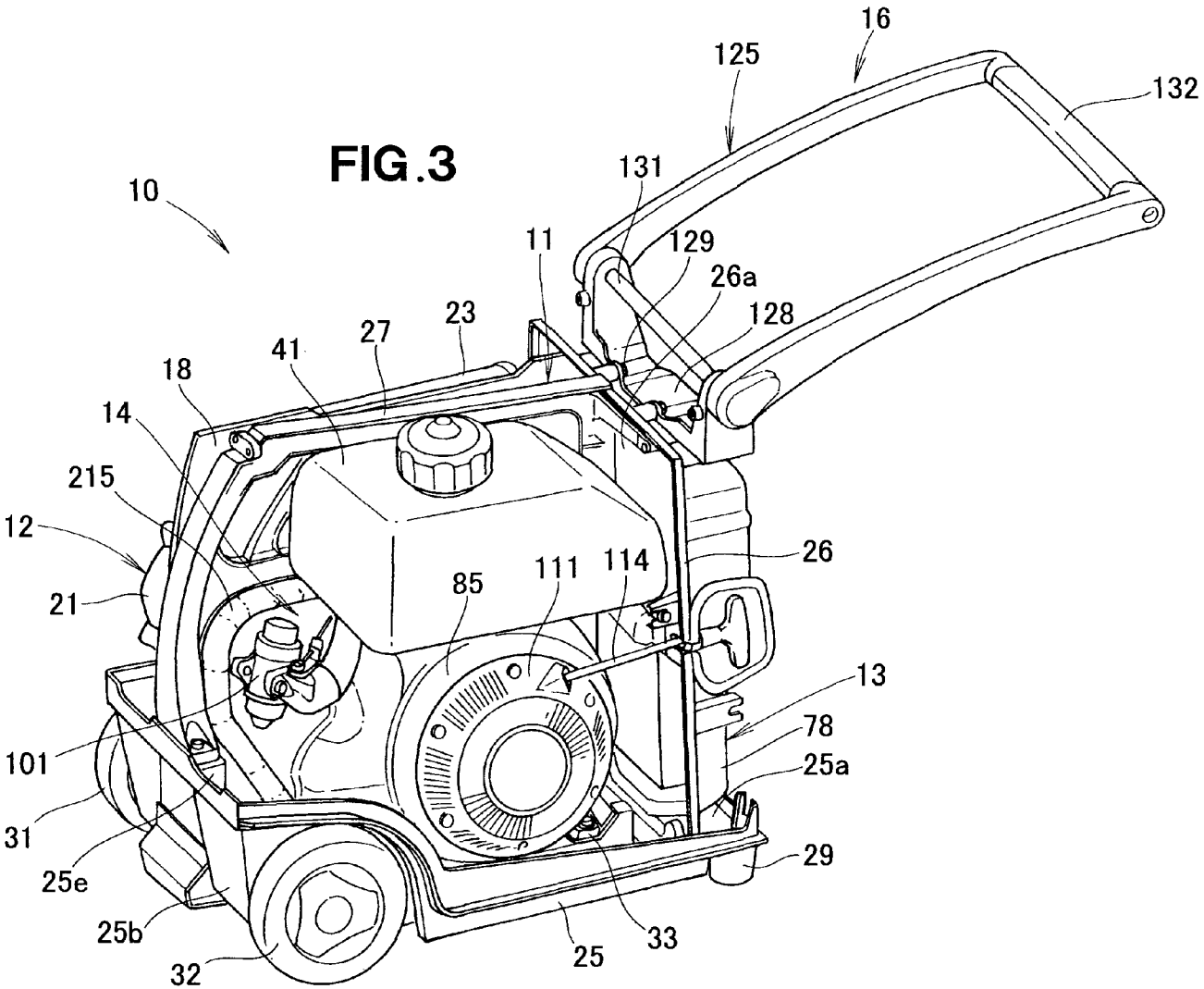
FIG. 3 is a perspective view showing the engine-driven power generator apparatus of FIG. 1 with a case removed therefrom.
Figure 4:
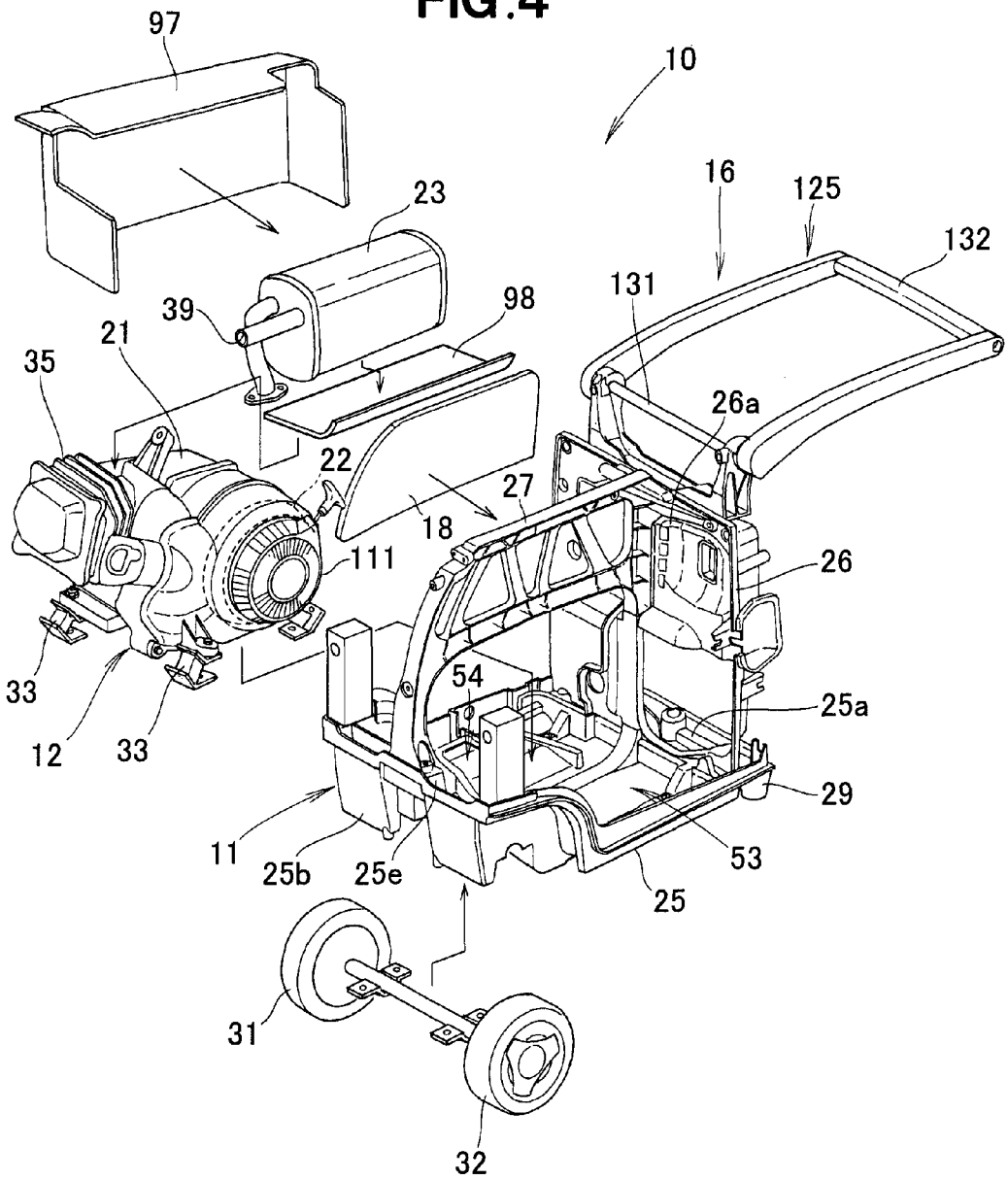
FIG. 4 is an exploded perspective view of the engine-driven power generator apparatus of FIG. 3.

FIG. 3 is a perspective view showing the engine-driven power generator apparatus 10 with the case 17 removed, and FIG. 4 is an exploded perspective view of the engine-driven power generator apparatus 10 of FIG. 3.

The framework unit 11 includes the lower cover 25 supporting the engine/power generator unit 12, a vertical frame member 26 extending upward from near the front end (or one end) region 25*a* of the lower cover 25, and a center frame member 27 fixed to and spanning between an upper middle portion 26*a* of the vertical frame member 26 and a rear-end (or other-end) middle portion 25*e* of the lower cover 25. The center frame member 27 is located over a central portion 24 (FIG. 5) of the engine/power generator unit 12.

The air intake/fuel supply mechanism 14, which supplies fuel (i.e., air-fuel mixture) to the engine 21 of the engine/power generator unit 12, includes a fuel tank 41 disposed above the power generator 22, and a carburetor 101 provided on the cylinder block 35 for mixing the fuel supplied from the fuel tank 41 with air supplied from an air cleaner (not shown) to thereby supply a resultant air-fuel mixture to the engine 21.

The carrying structure 16 includes the left and right wheels 31 and 32, front and rear fixed handles 119 and 118 (see FIGS. 1 and 2), and the pulling handle 125. As shown in FIG. 2, the front fixed handle 119 is provided to cover a support shaft 131 of the pulling handle 125.

The human operator can pull forward the engine-driven power generator apparatus 10 by pivoting upward the pulling handle 125 about the support shaft 131 to a pulling position (i.e., position shown in the figures) and then holding and pulling a grip 132 of the pulling handle 125. Namely, the left and right leg portions 29 are lifted from the ground (road surface) by the human operator holding and lifting the grip 132. Then, as the human operator pulls the grip 132, the left and right wheels 31 and 32 rotate, so that the human operator can move or carry the engine-driven power generator apparatus 10.

Further, the human operator can fix the pulling handle 125 to a front case section (or front wall portion) 46 (FIG. 1) by pivoting downward the pulling handle 125 about the support shaft 131. In this state, the human operator can heave (or lift) and carry the engine-driven power generator apparatus 10 to desired places by grasping the front and rear fixed handles 119 and 118.

Figure 5:
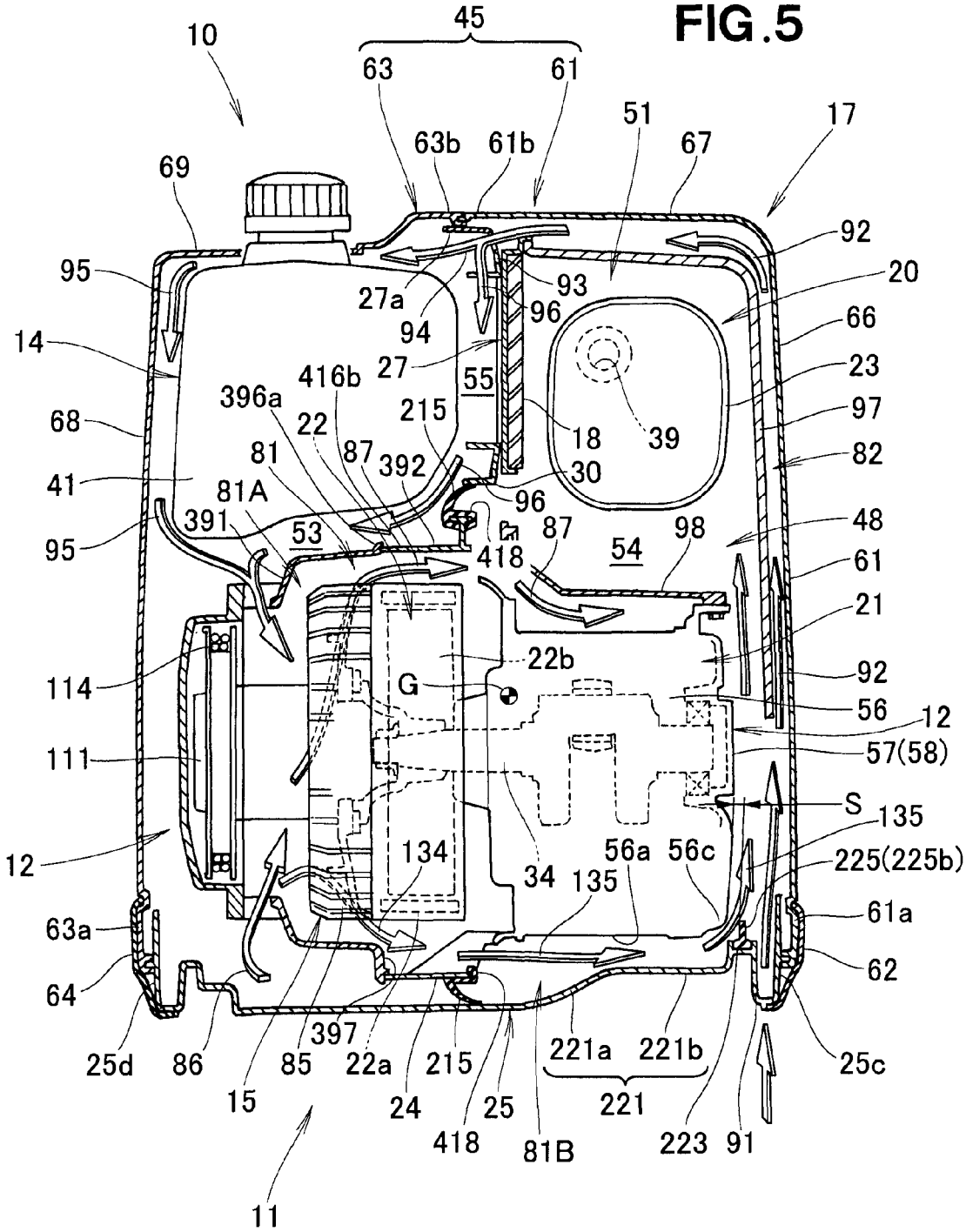
FIG. 5 is a sectional view taken along the 5-5 line of FIG. 1.
Figure 6:
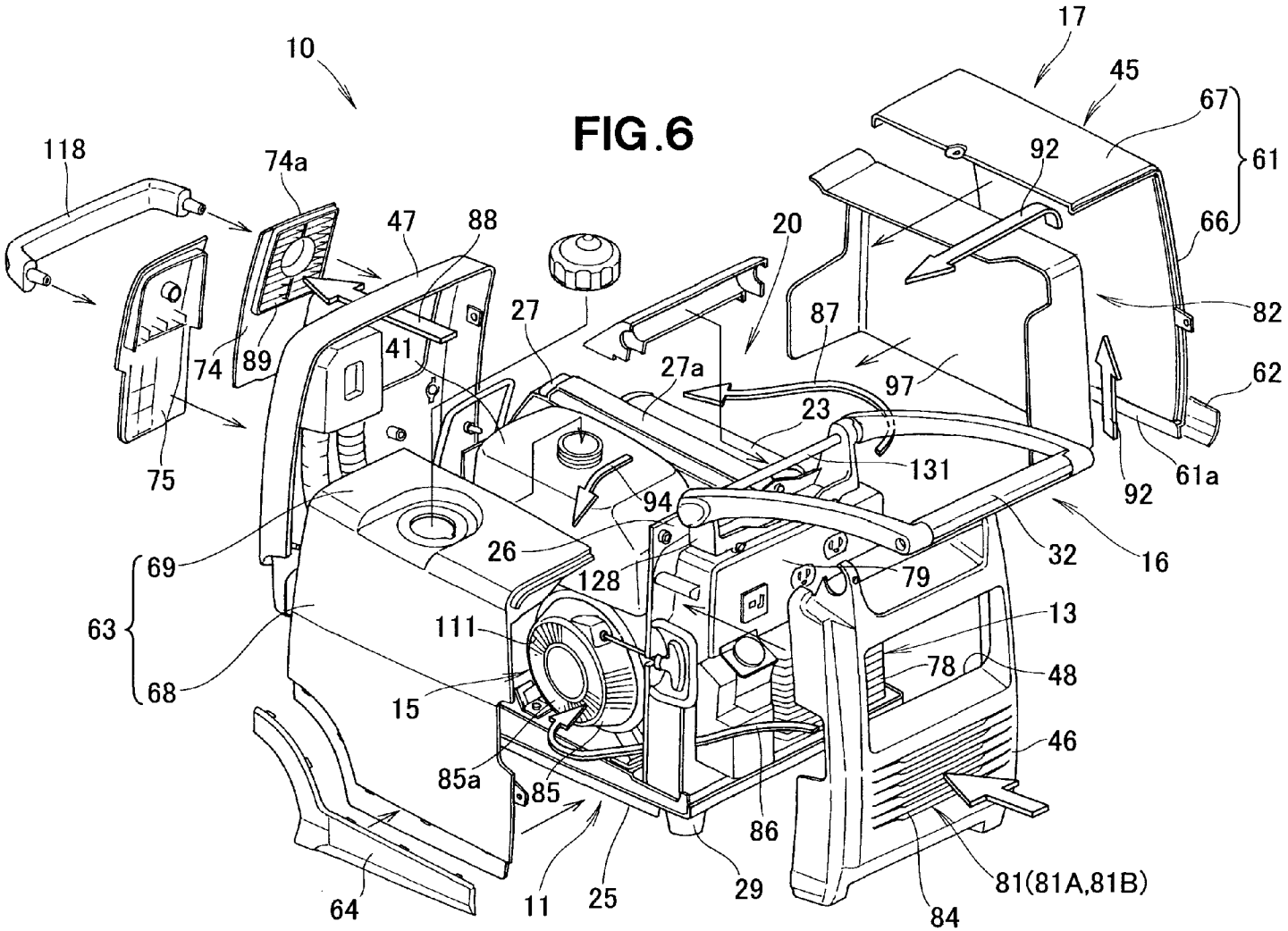
FIG. 6 is an exploded perspective view showing the engine-driven power generator apparatus.

FIG. 5 is a sectional view taken along the 5-5 line of FIG. 1, and FIG. 6 is an exploded perspective view showing the engine-driven power generator apparatus 10.

The engine/power generator unit 12 is fixedly mounted to (supported by) the lower cover 25 with the drive shaft 34 of the engine 21 oriented in a left-right horizontal direction. Cooling fan 85 is connected to the drive shaft 34. More specifically, in the engine 21 of the engine/power generator unit 12, a bottom portion 56*a* of a crankcase 56 is supported by the lower cover 25 via the mounting members 33 (see FIG. 2).

In the engine/power generator unit 12, the drive shaft 34 rotates by being driven by the engine 21, and the rotation of the drive shaft 34 is transmitted to the cooling fan 85 so that the cooling fan 85 rotates. By the rotation of the cooling fan 85, a rotor 22*a* of the power generator 22 rotates around the outer periphery of the stator 22*b*, and such rotation of the rotor 22*a* generates electric power.

The center frame member 27 of the framework unit 11 is disposed over the engine/power generator unit 12, and a heat insulating member 18 is provided on the center frame member 27. The heat insulating member 18 partitions a unit accommodating area 51 into a hot area 54 where the engine 21 is located and a cool area 53 where the power generator 22 is located.

Figure 7:
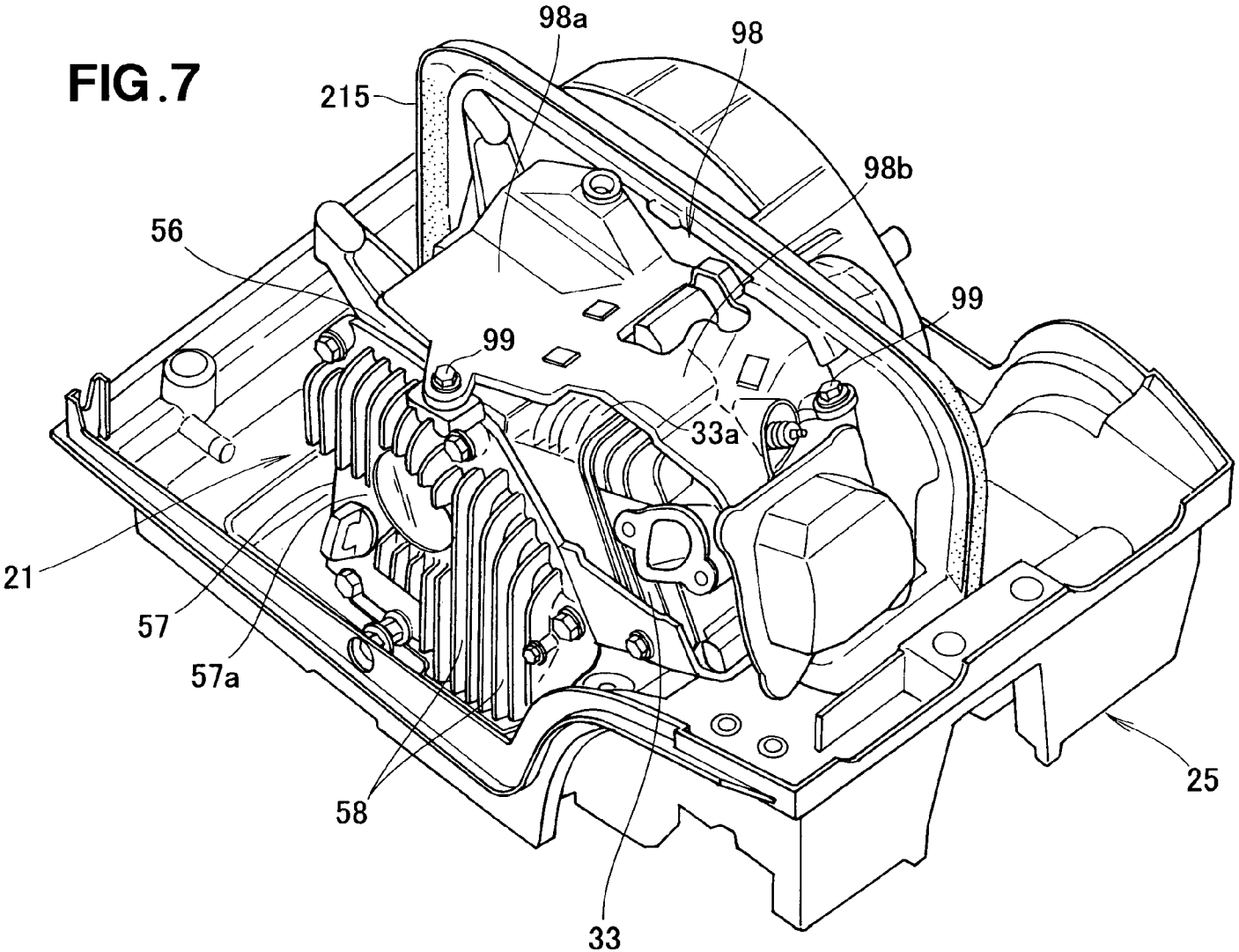
FIG. 7 is a perspective view showing an engine/power generator unit attached to a lower cover.

Of the engine/power generator unit 12, an elastic sealing member 215 is provided on the entire outer periphery of a boundary section 24 between the engine 21 and the power generator 22 (see also FIGS. 2 and 7). The elastic sealing member 215 separates the hot area 54 and cool area 53 from each other.

The muffler 23 is provided over the engine 21 of the engine/power generator unit 12. The muffler 23 discharges exhaust gas, emitted from the cylinder block 35 (FIG. 2) of the engine 21, through an exhaust port 39 (see also FIG. 1).

Further, the fuel tank 41 of the air intake/fuel supply mechanism 14 is disposed over the engine/power generator unit 12, and the electric component section 13 is disposed forwardly of the engine/power generator unit 12. The engine/power generator unit 12, muffler 23, fuel tank 41 and electric component section 13 are accommodated within the case 17 formed in a generally inverted-U sectional shape.

The electric component section 13, which controls the output of the engine/power generator unit 12, includes an operation panel 79 provided in its upper half portion and an inverter unit 78 provided in its lower half portion. The operation panel 79 includes an engine start switch, AC and DC terminals for outputting generated electric power etc. and so on, which are exposed to the outside through an opening 48 of the front case section 46. The inverter unit 78 controls the output frequency of the power generator 22.

The case 17 is formed of resin, such as polypropylene, and includes a case body 45, the front case section 46 and a rear case section (or rear wall portion) 47. The accommodating space 20 is defined by the lower cover 25 and the case 17 provided over the lower cover 25.

The accommodating space 20 is divided into a unit accommodating area 51 and an electric component accommodating area 52 (FIG. 2), and the unit accommodating area 51 is divided into the cool area 53 and hot area 54.

The engine/power generator unit 12 is accommodated in the unit accommodating area 51, and the electric component section 13 is accommodated in the electric component accommodating area 52. Further, the engine 21 and muffler 23 are accommodated in the hot area 54 located to the left of the center frame member 27, and the power generator 22, fuel tank 41, carburetor 101, recoil starter 111 and cooling fan 85 are accommodated in the cool area 53 located to the right of the center frame member 27 (heat insulating member 18). The heat insulating member 18 functions also as a shroud for directing the external air (cooling air), having been sent to the cylinder block 35, to a cooling air discharging louver portion (outlet port) 89 (FIG. 1).

As seen in FIGS. 4 and 6, the pulling handle 125 of the carrying structure 16 is connected at its opposite ends to the vertical frame member 26 of the framework unit 11. More specifically, the pulling handle 125 is vertically pivotably connected to the upper middle portion 26*a* of the vertical frame member 26 via a handle support portion 128. The handle support portion 128 is secured, by means of bolts 129, to the upper middle portion 26*a* of the vertical frame member 26 together with the center frame member 27.

As seen in FIG. 5, the cooling structure 15 directs external air (cooling air) to the cooling fan 85 through rotation of the cooling fan 85, then directs the cooling air to the engine 21 via a fan cover 391 and cover guide 392 as indicated by a white arrow 134, and then sends the cooling air, having been directed to the engine 21, to the cylinder block 35 via an engine shroud 98 and lower cover 25 as indicated by a white arrow 135 to thereby cool the engine 21 and muffler 23.

The case body 45 is a member covering left and right side regions and upper region of the unit accommodating area 51. The case body 45 includes a left side case section 61 covering the hot area 54, a left decorative cover 62 provided on a lower portion of the left side case section 61, a right side case section 63 covering the cool area 53, and a right decorative cover 64 provided on a lower portion of the right side case section 63.

The left side case section 61 has a lower end portion 61*a* fixed to a left side portion 25*c* of the lower cover 25, and an upper end portion 61*b* fixed to an upper end portion 27*a* of the framework unit 11 (center frame member 27). The left side case section 61 is formed in a substantially L sectional shape with a left side wall portion 66 and left upper wall portion 67.

The right side case section 63 has a lower end portion 63*a* fixed to a right side portion 25*d* of the lower cover 25, and an upper end portion 63*b* fixed to the upper end portion 27*a* of the framework unit 11 (center frame member 27). The right side case section 63 is formed in a substantially L sectional shape with a right side wall portion 68 and right upper wall portion 69.

The left upper wall portion 67 of the left side case section 61 and the right upper wall portion 69 of the right side case section 63 together constitute an upper wall portion of the case 17.

The front case section 46 is formed as a lid of a substantially rectangular shape, which constitutes a front wall portion of the case 17 by being fixedly mounted to the lower cover 25, vertical frame member 26, etc. of the framework unit 11. Front region of the electric component accommodating area 52 is covered with the front case section 46.

The rear case section 47 is formed as a lid of a substantially rectangular shape, which constitutes a rear wall portion of the case 17 by being fixedly mounted to the lower cover 25, center frame member 27, etc. of the framework unit 11. Rear region of the unit accommodating area 51 is covered with the rear case section 47.

Left cover portion 74 is provided on a left half portion of the rear case section 47, and a right cover portion 75 is provided on a right half portion of the rear case section 47.

Further, in the case 17, a pair of opposed left and right side wall portions 66 and 68 are spaced apart from each other with a predetermined interval therebetween, the front case section (front wall portion) 46 is mounted to the respective front ends of the left and right side wall portions 66 and 68, and the rear case section (rear wall portion) 47 is mounted to the respective rear ends of the left and right side wall portions 66 and 68. The case 17 is formed in a substantially rectangular parallelepiped shape with the left and right side wall portions 66 and 68 and front and rear wall portions 46 and 47.

The cooling fan 85 is disposed in opposed relation to the right side wall portion 68 with the recoil starter 111 interposed between the right side wall portion 68 and the cooling fan 85, and a lid member 57 of the engine 21 is disposed in opposed relation to the left side wall portion 66.

The cooling structure 15 includes the inverter unit 78 of the electric component section 13, an engine cooling structure 81 for cooling the engine 21 and muffler 23, and a case cooling structure (or second cooling structure) 82 for cooling the case 17.

The engine cooling structure 81 includes a first engine cooling structure (or first cooling structure) 81A for cooling an upper portion of the engine 21 and muffler 23, and a second engine cooling structure 81B for cooling a lower portion of the engine 21 and muffler 23.

The first engine cooling structure 81A includes: an external air introducing louver portion (or first inlet port) 84 provided in a lower half portion of the front case section 46; a first cooling flow passage 86 of a curved shaped for directing the external air (or cooling air), having been introduced via the louver portion 84, to the cooling fan 85 by way of the inverter unit 78; a second cooling flow passage (or cylinder cooling flow passage) 87 (see also FIG. 2) for directing the cooling air, having been directed to the cooling fan 85, to the cylinder block 35 of the engine 21; and a third cooling flow passage 88 for directing the cooling air, having passed along the cylinder block 35, to the cooling air discharging louver portion (or outlet port) 89 for discharging the cooling air, directed thereto via the third cooling flow passage 88, to outside of the case 17. Note that the first cooling flow passage 86, second cooling flow passage 87 and third cooling flow passage 88 together constitute a first cooling flow passage means or section and are indicated in FIG. 6 etc. by white arrows for convenience sake.

The cooling air discharging louver portion (outlet port) 89 is provided in an upper half portion 74*a* of the left cover portion 74 (i.e., upper portion of the case 17). The second cooling flow passage 87 is defined by the engine shroud 98 provided over the cylinder block 35.

The cooling fan 85 is disposed in opposed relation to the right side wall portion 68 and the external air introducing louver portion 84 of the first engine cooling structure 81A is provided in the front case section 46, as noted above. Namely, the external air introducing louver portion 84 is disposed adjacent to one side of the cooling fan 85, and the cooling air discharging louver portion 89 is provided in the rear case section 47.

The cooling air sucked in through the external air introducing louver portion 84 is directed meanderingly or curvingly toward the front surface 85*a* of the cooling fan 85 via the first cooling flow passage 86, to thereby cool the engine 21.

The cooling air having cooled the engine 21 is directed toward the left side wall portion 66 (more specifically to a case shroud 97) via the second cooling flow passage 87, and then directed toward the cooling air discharging louver portion 89 via the side wall portion 66 (more specifically via the case shroud 97). Thus, in the instant embodiment, the cooling air having cooled the engine 21 can be directed meanderingly or curvingly to the discharging louver portion 89 to be discharged therethrough. The case shroud 97 is disposed a predetermined distance or interval from the inner surface of the left side case section 61.

Because the cooling air is discharged after having flown meanderingly or curvingly through the case 17 in the aforementioned manner, the instant embodiment can prevent air suction and exhaust sound (or noise) of the engine 21 from easily leaking out of the cooling air discharging louver portion 89 together with the cooling air, so that it can effectively reduce the air suction and exhaust sound.

Namely, with the first engine cooling structure 81A constructed in the aforementioned manner, external air (cooling air) introduced into the case 17 through the introducing louver portion 84 can flow along the inverter unit 78, upper portion (mainly the cylinder block 35) of the engine 21 and muffler 23. Thus, the inverter unit 78, upper portion (mainly the cylinder block 35) of the engine 21 and muffler 23 can be effectively cooled by the cooling air. Then, the cooling air having cooled the inverter unit 78, upper portion (mainly the cylinder block 35) of the engine 21 and muffler 23 can be discharged to outside of the case 17 through the cooling air discharging louver portion (outlet port) 89. The first engine cooling structure 81A will be later described in greater detail with reference to FIG. 8.

As shown in FIGS. 5 and 6, the case cooling structure 82 includes: an external air introducing slit portion (second inlet port) 91 provided in the left side portion 25*c* of the lower cover 25; a fourth cooling flow passage (case cooling flow passage) 92 for directing the external air, having been introduced through the introducing slit portion 91, to a region over the muffler 23 along the left side case section 61; a fifth cooling flow passage (case cooling flow passage) 94 for directing the external air from the fourth cooling flow passage 92 to a region over the fuel tank 41 through guide holes 93; and a sixth cooling flow passage (case cooling flow passage) 95 for directing the external air, having been set to the region over the fuel tank 41, to the cooling fan 85 along the right side case section 63. Note that the fourth cooling flow passage 92, fifth cooling flow passage 94 and sixth cooling flow passage 95 together constitute a second cooling flow passage means or section and are indicated in the figures by white arrows for convenience sake.

In the case cooling structure 82, the introducing slit portion (second inlet port) 91 is formed along the left side case section 61 for introducing therethrough external or cooling air. The introducing slit portion 91 is in the form of a plurality of slits formed in the left side portion 25*c* of the lower cover 25 and has a predetermined length in a front-rear direction of the apparatus. These slits are formed at predetermined intervals along the left side portion 25*c*. Consequently, the cooling air is allowed to flow smoothly along the left side case section 61, which can effectively prevent heat of the engine 21 from undesirably staying near the inner surface of the case 17 and thus can lower the temperature of the case 17.

The fourth cooling flow passage 92 is defined between the left side case section 61 and the case shroud 97 disposed a predetermined distance from the left side case section 61. Thus, with this fourth cooling flow passage 92, the cooling air can flow reliably and smoothly along the inner surface of the left side case section 61 and thus can effectively lower the temperature of the case 17.

With the case cooling structure 82 constructed in the aforementioned manner, the external air (cooling air) introduced into the case 17 through the slit portion 91 is allowed to flow smoothly along the inner surfaces of the left side case section 61 and right side case section 63 and thereby effectively cool the left side case section 61 and right side case section 63.

Further, as shown in FIGS. 5 and 6, the second engine cooling structure 81B includes: a seventh cooling flow passage 134 branching from the first cooling flow passage 86 of the first engine cooling structure 81A for directing the cooling air to a region under the power generator 22; an eighth cooling flow passage 135 for directing the cooling air from the seventh cooling flow passage 134 to heat radiating fins 58 that directs the cooling air from the eighth cooling flow passage 135 upwardly to a region over the crankcase 56; and the aforementioned discharging louver portion 89 for discharging the cooling air, having ascended to the region over the crankcase 56 along the heat radiating fins 58, out of the case 17. Note that the seventh cooling flow passage 134 and eighth cooling flow passage 135 are indicated by white arrows for convenience sake.

The same discharging louver portion 89 is shared between the second engine cooling structure 81B and the first engine cooling structure 81A. The seventh cooling flow passage 134 causes the cooling air to branch off the first cooling flow passage 86 of the first engine cooling structure 81A and directs the branched cooling air to the region under the power generator 22 by way of the cooling fan 85. The eighth cooling flow passage 135 is defined by the lower cover 25 and bottom portion 56*a* of the crankcase 56 and directs the cooling air to the heat radiating fins 58.

With the second engine cooling structure 81B constructed in the aforementioned manner, the external air (cooling air) introduced into the case 17 through the introducing louver portion 84 can be branched to the seventh cooling flow passage 134 so that it is directed to the region under the power generator 22 to cool the lower portion of the power generator 22. Further, the cooling air having been directed to the region under the power generator 22 can be further directed, via the eighth cooling flow passage 135, to the bottom portion 56*a* of the crankcase 56 to thereby cool the bottom portion 56*a*.

Further, the cooling air having been directed to the heat radiating fins 58 via the eighth cooling flow passage 135 can be directed upward along the heat radiating fins 58, as indicated by upward arrows, to thereby cool the heat radiating fins 58. Then, the cooling air having cooled the heat radiating fins 58 can be discharged out of the case 17 through the discharging louver portion 89. The second engine cooling structure 81B will be later described in greater detail with reference to FIG. 8.

Figure 8:
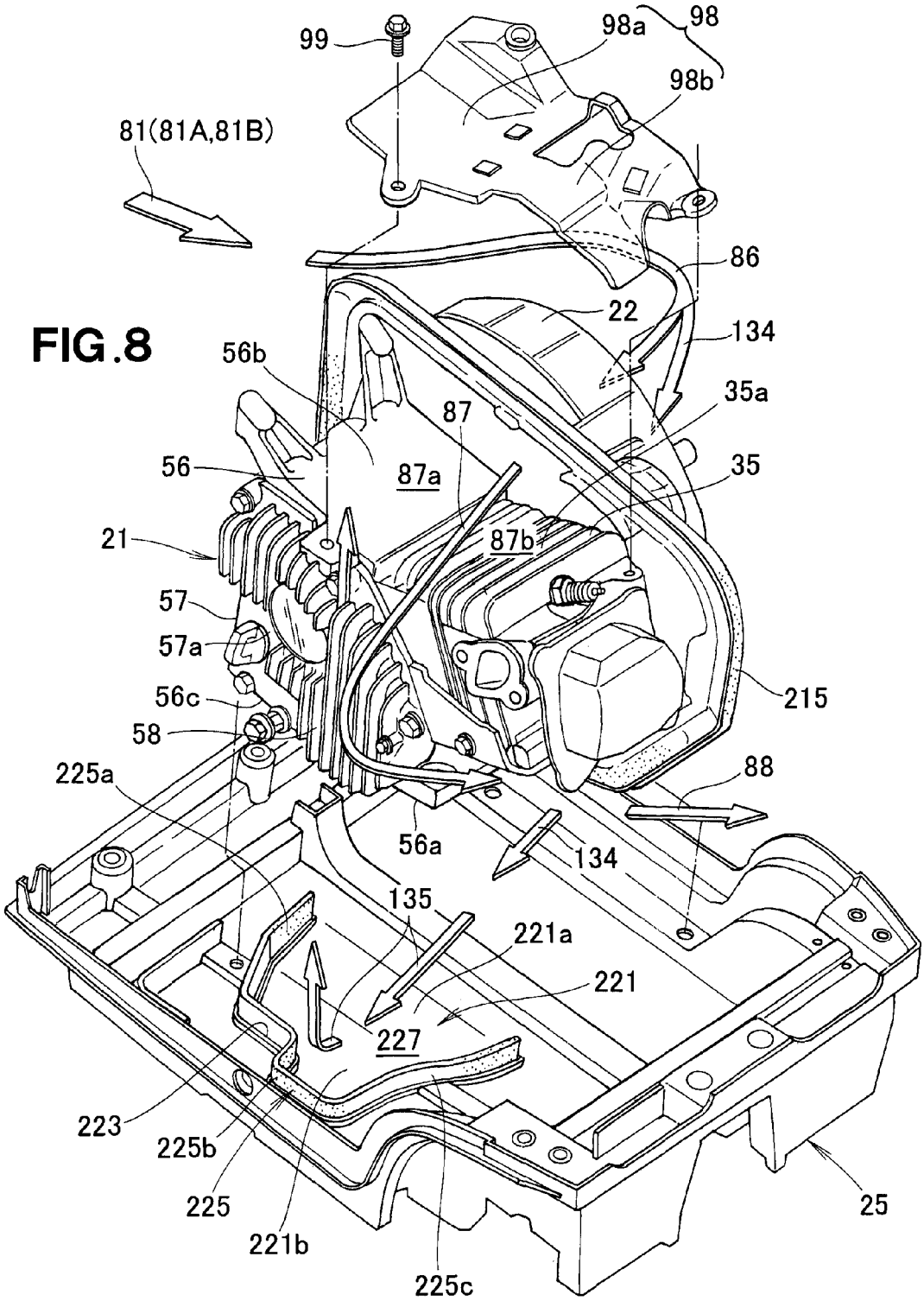
FIG. 8 is an exploded view showing the engine/power generator unit of FIG. 7 detached from the lower cover.

FIG. 7 is a perspective view showing the engine/power generator unit 12 attached to the lower cover 25, and FIG. 8 is an exploded view showing the engine/power generator unit 12 of FIG. 7 detached from the lower cover 25.

The engine shroud 98 is fixed to the upper sides of the crankcase 56 and cylinder block 35 with a predetermined gap therefrom. Front half space 87*a* is defined by the upper side of the crankcase 56 and a front half portion 98*a* of the engine shroud 98, and a rear half space 87*b* is defined by the upper side 35*a* of the crankcase 56 and a rear half portion 98*b* of the engine shroud 98.

The front half space 87*a* and the rear half space 87*b* together constitute the second cooling flow passage 87 of the first engine cooling structure 81A. Via the first engine cooling structure 81A, the cooling air can be reliably directed to the cylinder block 35 to efficiently cool the cylinder block 35.

The following describe in greater detail the second engine cooling structure 81B. Opening of the crankcase 56 is closed with the lid member 57 attached to the left side of the crankcase 56 of the engine 21. The heat radiating fins 58 are fixed to a side wall portion 57*a* of the lid member 57 in a vertical orientation. The side wall portion 57*a* constitutes a wall portion of the crankcase 56 located opposite from the cooling fan 85.

With the engine/power generator unit 12 fixedly mounted to the lower cover 25 via the mounting members 33 (see FIG. 2), the bottom portion 56*a* of the crankcase 56 extends along a guide section 221 of the lower cover 25. More specifically, the bottom portion 56*a* of the crankcase 56 is disposed at a predetermined distance from the upper surface of the guide section 221.

The guide section 221 has a slanting portion 221*a* formed adjacent to the center of the lower cover 25, a horizontal portion 221*b* formed laterally outwardly of the slanting portion 221*a*, and a mounting groove portion 223 formed along the outer edge of the guide section 221.

The slanting portion 221*a* slants outwardly and upwardly from near the center of the lower cover 25, and the horizontal portion 221*b* is located at the upper end of the upward slanting portion 221*a* and under the bottom portion 56*a* of the crankcase 56 with a predetermined interval left between the horizontal portion 221*b* and bottom portion 56*a*. The horizontal portion 221*b* extends substantially parallel to the bottom portion 56*a* of the crankcase 56.

The mounting groove portion 223 is formed along the outer periphery of the bottom portion 56*a* of the crankcase 56 of the crankcase 56 disposed thereover. Vertically-projecting guide portion 225 is fixedly mounted in the mounting groove portion 223.

The projecting guide portion 225 has a front projection 225*a* projecting upward along the front outer periphery of the bottom portion 56*a*, a middle projection 225*b* projecting upward along the left side outer periphery 56*c* of the bottom portion 56*a*, and a rear projection 225*c* projecting upward along the rear outer periphery of the bottom portion 56*a*. The middle projection 225*b* is horizontally spaced by a gap S (see FIG. 5) from the left side outer periphery 56*c* of the bottom portion 56*a*.

Space 227 is defined by the bottom portion 56*a* of the crankcase 56 and the guide section 221 of the lower cover 25. The space 227 has its front portion closed with the front projection 225*a* and its rear portion closed with the rear projection 225*c*. Further, the middle projection 225*b* is located on the left side of the space 227.

The bottom portion 56*a* of the crankcase 56, guide section 221 of the lower cover 25 and projecting guide portion 225 together constitute the eighth cooling flow passage 135 of the second engine cooling structure 81B.

With the eighth cooling flow passage 135 of the second engine cooling structure 81B, the cooling air having been directed to the region under the power generator 22 can be efficiently directed to the heat radiating fins 58 via the projections 225*a* and 225*c*, so that the bottom portion 56*a* of the crankcase 56 can be cooled. Further, with the eighth cooling flow passage 135, the cooling air can be efficiently deflected upward by the middle projection 225*b*.

The heat radiating fins 58 are disposed in a vertical orientation over the middle projection 225*b*, so that the cooling air deflected upward by the middle projection 225*b* can be efficiently directed along the heat radiating fins 58 as indicated by a white arrow. Namely, by the provision of the projecting guide portion 225, the eighth cooling flow passage 135 can efficiently direct the cooling air to the heat radiating fins 58.

With reference back to FIG. 6, the following describe an example specific manner in which the first engine cooling structure 81A cools the inverter unit 78, engine 21, muffler 23, etc. By operation of the cooling fan 85 (FIG. 5), external air (cooling air) is introduced into the case 17 through the introducing louver portion 84. The thus-introduced cooling air is directed curvingly to the heat radiating fins 85 via the first cooling flow passage 86.

The inverter unit 78 is cooled by the cooling air flowing along the first cooling flow passage 86. Then, the cooling air emitted from the cooling fan 85 is directed to the second cooling flow passage 87, so that an upper portion 56*b* of the crankcase 56 and upper portion 35*a* of the cylinder block 35 (see FIG. 8) are cooled by the cooling air flowing along the second cooling flow passage 87.

The cooling air having cooled the upper portion 56*b* of the crankcase 56 and upper portion 35*a* of the cylinder block 35 is then guided by the left side wall portion 66 (more specifically, by the inner surface of the case shroud 97) and directed curvingly to the muffler 23.

The muffler 23 is cooled by the cooling air flowing along the second cooling flow passage 87. The cooling air having cooled the muffler 23 is directed to the third cooling flow passage 88, after which it is discharged out of the case 17 through the discharging louver portion 89.

As set forth above, the cooling air introduced into the case 17 through the introducing louver portion 84 is directed curvingly via the first cooling flow passage 86 and then via the third cooling flow passage 88. Thus, the cooling air having cooled the upper portion 56*b* of the crankcase 56 and upper portion 35*a* of the cylinder block 35 can be discharged through the discharging louver portion 89 after having flown meanderingly within the case 17.

Namely, because the cooling air is discharged after having meandered along the first cooling flow passage 86 and second cooling flow passage 87, the instant embodiment can make it difficult for air suction and exhaust sound (or noise) of the engine 21 to leak out of the cooling air discharging louver portion 89 together with the cooling air, so that it can effectively reduce the air suction and exhaust sound without providing a particular sound absorbing material on the inner surface of the case 17.

Because the instant embodiment of the engine-driven power generator apparatus 10 can eliminate the need for providing a sound absorbing material on the inner surface of the case 17, there is no need to secure a space for providing a sound absorbing material, so that the engine-driven power generator apparatus 10 can be constructed in a reduced size. As a result, it is possible to reduce suction and exhaust sound of the engine without impairing the mobility and portability of the power generator apparatus 10.

Next, with reference back to FIGS. 6 and 8, the following describe an example manner in which the second engine cooling structure 81B cools the bottom portion 56*a* of the crankcase 56, lid member 57 of the crankcase 56, etc. By operation of the cooling fan 85 (FIG. 5), external air (cooling air) introduced into the case 17 through the introducing louver portion 84 is branched to the seventh cooling flow passage 134, so that the cooling air is directed to the region under the power generator 22 and thus a lower portion of the power generator 22 is cooled by the cooling air flowing along the seventh cooling flow passage 134.

The cooling air having cooled the lower portion of the power generator 22 is then directed to the eighth cooling flow passage 138 so that the cooling air flows along the bottom portion 56*a* of the crankcase 56 to thereby cool the bottom portion 56*a*.

The cooling air having passed the bottom portion 56*a* of the crankcase 56 is deflected upward by the middle projection 225*b* of the projecting guide portion 225 and then ascends along the heat radiating fins 58. The lid member 57 of the crankcase 56 (heat radiating fins 58) is cooled by the cooling air flowing along the heat radiating fins 58, and then the cooling air having cooled the lid member 57 (heat radiating fins 58) is discharged out of the case 17 through the discharging louver portion 89.

Namely, the eighth cooling flow passage 138 is defined by the guide section 221 of the lower cover 25 and bottom portion 56*a* of the crankcase 56, so as to direct the cooling air to the heat radiating fins 58. By the provision of the projecting guide portion 225 (more specifically, the middle projection 225*b*), the eighth cooling flow passage 135 can direct the cooling air along the bottom portion 56*a* of the crankcase 56 with an even further enhanced efficiency, so that the bottom portion 56*a* of the crankcase 56 can be cooled, with an even further enhanced efficiency, by the cooling air directed via the eighth cooling flow passage 135.

Further, the heat radiating fins 58 are fixed to the side wall portion 57*a* of the lid member 57 in a vertical orientation, so that the cooling air having been directed to the heat radiating fins 58 via the eighth cooling flow passage 135 can be smoothly directed upward along the vertically-oriented heat radiating fins 58 to thereby cool the side wall portion 57*a* with an even further enhanced efficiency.

Further, with the cooling air discharging louver portion 89 provided in the upper half portion 74*a* of the left cover portion 74 (see FIG. 6), the cooling air having ascended along the heat radiating fins 58 can be efficiently discharged out of the case 17 through the discharging louver portion 89.

Because the bottom portion 56*a* of the crankcase 56 can be efficiently cooled by the cooling air directed to the eighth cooling flow passage 135 and the side wall portion 57*a* can be cooled by the cooling air supplied to the heat radiating fins 58, the instant embodiment can cool the engine 21 with an enhanced efficiency.

In addition, because the eighth cooling flow passage 138 is defined by the guide section 221 of the lower cover 25 and bottom portion 56*a* of the crankcase 56, the lower cover 25 can be used also as part of the eighth cooling flow passage 135.

As a consequence, the instant embodiment can dispense with a large-size shroud as required in the prior art counterpart and thus eliminate the need for a space for providing the large-size shroud. As a result, the engine-driven power generator apparatus 10 can be significantly reduced in weight and size, and thus, an enhanced mobility and portability of the engine-driven power generator apparatus 10 can be achieved.

With reference back to FIG. 5, the following describe an example manner in which the case cooling structure 82 cools the case 17. By operation of the cooling fan 85, external air (cooling air) is introduced into the case 17 through the introducing slit portion 91. The cooling air having been introduced into the case 17 is directed to the fourth cooling flow passage 92 and smoothly flows along the inner surface of the right side case section 63 while cooling the right side case section 63. The cooling air having cooled the right side case section 63 is then directed to the sixth cooling flow passage 95 and flows into the cooling fan 85.

Namely, the external air (cooling air) introduced into the case 17 through the introducing slit portion 91 can flow smoothly along the inner surfaces of the left and right side case sections 61 and 63. As a consequence, it is possible to prevent heat of the engine 21 from staying near the inner surface of the case 17 and thus can efficiently lower the temperature of the case 17.

Part of the cooling air having cooled the left side case section 61 and directed to the fifth cooling flow passage 94 flows along a cooling flow passage 96 between the fuel tank 41 and the heat insulating member 18. Then, the cooling air having flown through the cooling flow passage 96 flows into the sixth cooling flow passage 95 and is then directed into the cooling fan 85. Because the part of the cooling air is caused to flow through the cooling flow passage 96 as noted above, it is possible to cool the cool area 53 with an even further enhanced efficiency.

The shapes and constructions of the case 17, lower cover 25, front case section 46, rear case section 47, crankcase 56, heat radiating fins 58, cooling air discharging louver portion 89, external air introducing slit portion 91, case shroud 97, engine shroud 98, projecting guide portion 225, etc. are not limited to those illustratively shown and described herein, and they may be modified as necessary.

Figure 9:
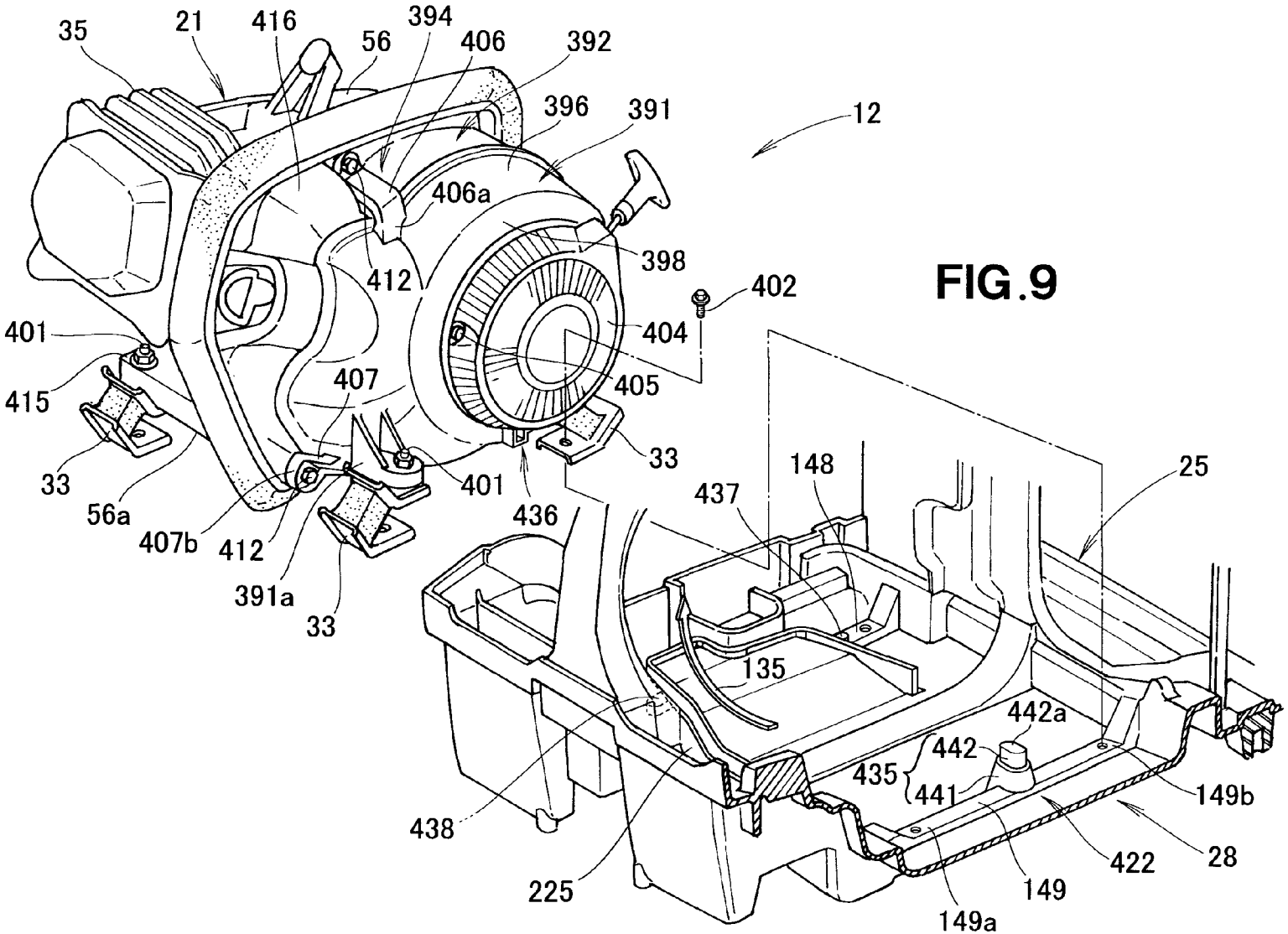
FIG. 9 is an exploded perspective view showing the engine/power generator unit detached from the lower cover.
Figure 10:
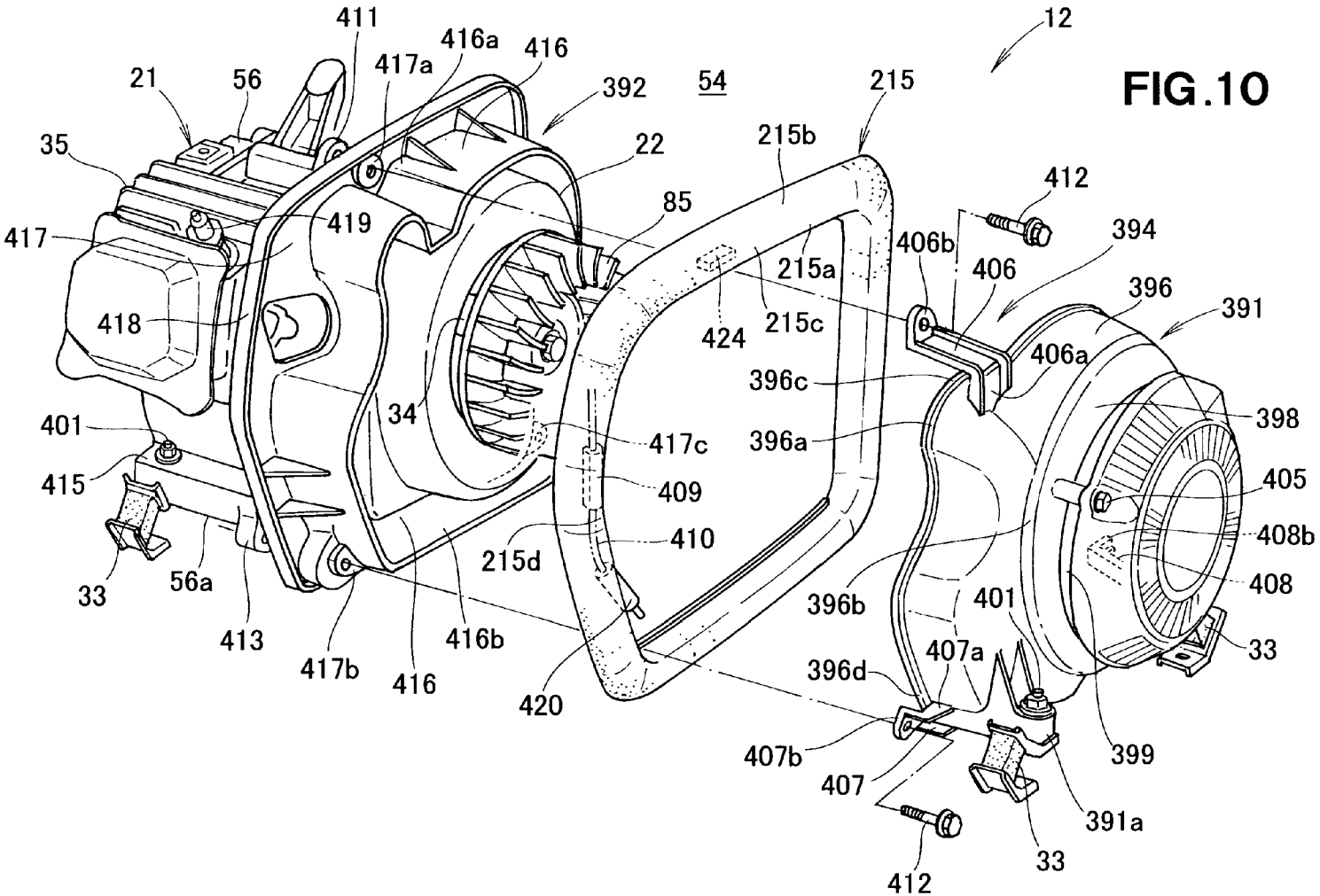
FIG. 10 is an exploded perspective view of the engine/power generator unit.

FIG. 9 is an exploded perspective view showing the engine/power generator unit 12 detached from the lower cover 25, and FIG. 10 is an exploded perspective view of the engine/power generator unit 12.

The engine/power generator unit 12 includes: the fan cover 391 made of metal and covering the cooling fan 85; a support section 394 provided on the fan cover 391 and extending to the engine 21; the cover guide 392 made of resin and fastened to the engine 21 together with the support section 394; and the elastic sealing member 215 provided on and along the outer periphery of the cover guide 392.

The metal fan cover 391 is a cover of aluminum which has a peripheral wall 396 formed to extend along the outer periphery of the cooling fan 85, an inner opening 397 (see FIG. 5) defined by an inner edge portion 396*a* of the peripheral wall 396, an outer wall 398 adjacent to an outer edge portion 396*b* of the peripheral wall 396, and an outer opening 399 formed in the outer wall 398.

The metal fan cover 391 has a rear lower end portion 391*a* and front lower end portion (not shown) to which the mounting members 33 are fastened by means of bolts 401 (only one of the bolts 401 is shown). The rear lower end portion 39 la and front lower end portion are provided in front-right symmetric relation to each other. Namely, the metal fan cover 391 is fixedly mounted or supported to the below cover 25 via the mounting members 33 fastened to the rear lower end portion 39 la and front lower end portion thereof.

More specifically, the mounting member 33 fastened to the rear lower end portion 391*a* is also fastened to a rear end portion 149*a* of a right reinforcing rib 149 by means of a bolt 402, and the right reinforcing rib 149 is provided on the lower cover 25 near the right side of the cover 25. The mounting member 33 fastened to the front lower end portion is also fastened to a front end portion 149*b* of the right reinforcing rib 149 by means of a bolt 402.

The other two mounting members 33 are fastened to front and rear mounting portions 414 and 415 (FIG. 16) of the bottom portion 56*a* of the crankcase 56 by means of bolts 401.

Figure 16:
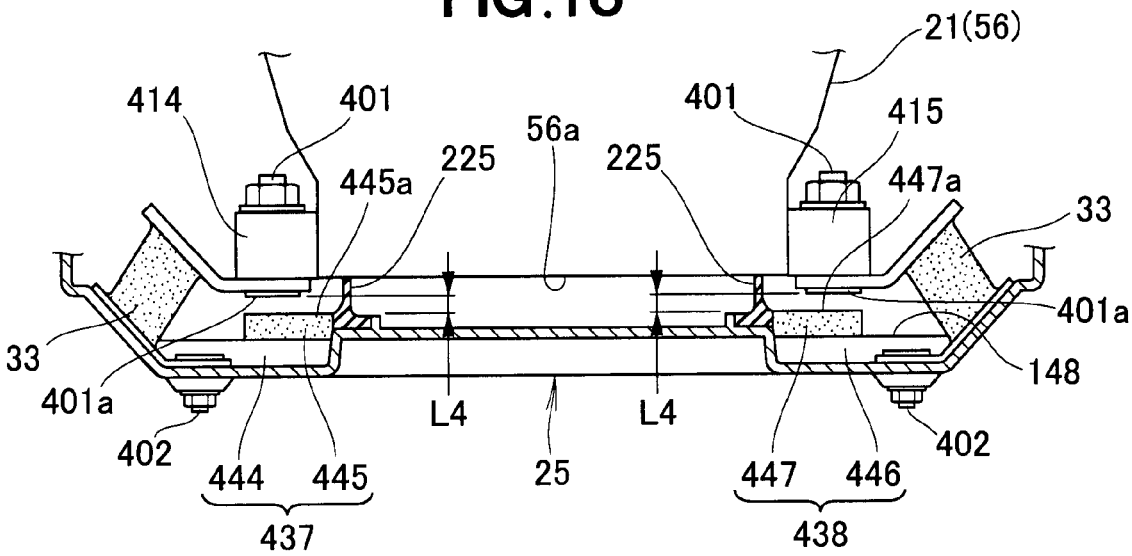
FIG. 16 is a side view showing a lower front bump stopper and lower rear bump stopper of the engine/power generator unit.

The mounting member 33 fastened to the rear mounting portion 415 is also fastened to a rear end portion of a left reinforcing rib 148 by means of a bolt 402 (FIG. 16), and the left reinforcing rib 148 is provided on the lower cover 25 near the left side of the cover 25. The mounting member 33 fastened to the front mounting portion 414 is also fastened to a front end portion of the left reinforcing rib 148 by means of a bolt 402 (FIG. 16).

As further shown in FIGS. 9 and 10, a recoil starter cover 404 is fixedly mounted to the outer wall 398 of the fan cover 391, and the recoil starter 111 (FIG. 5) is mounted to the recoil starter cover 404.

The support section 394 has first to third supporting leg portions 406-408 to be mounted to the engine 21 of the fan cover 391. The first supporting leg portion 406 has its proximal end portion 406*a* provided on an upper region 396*c* of the inner edge portion 396*a* of the fan cover 391, and its distal end portion 406*b* bolted to an upper mounting portion 411 of the crankcase 56. More specifically, the distal end portion 406*b* of the first supporting leg portion 406 is fastened, by means of a bolt 412, to the upper mounting portion 411 of the crankcase 56 together with an upper middle portion 417*a* of the cover guide 392.

The second supporting leg portion 407 has its proximal end portion 407*a* provided on a rear lower region 396*d* of the inner edge portion 396*a* of the fan cover 391, and its distal end portion 407*b* bolted to a rear mounting portion 413 of the bottom portion 56*a* of the crankcase 56 of the engine 21. More specifically, the distal end portion 407*b* of the second supporting leg portion 407 is fastened, by means of a bolt 412, to the rear mounting portion 413 of the crankcase 56 together with a rear lower portion 417*b* of the cover guide 392.

The third supporting leg portion 408, which is provided in front-right symmetric relation to the second supporting leg portion 407, has its proximal end portion provided on a front lower region of the inner edge portion 396*a* of the fan cover 391, and its distal end portion 408*b* bolted to a front mounting portion (not shown) of the bottom portion 56*a* of the crankcase 56 of the engine 21. More specifically, the distal end portion 408*b* of the third supporting leg portion 408 is fastened, by means of a bolt 412, to the front lower portion of the crankcase 56 together with a front lower portion 417*c* of the cover guide 392. The front mounting portion of the crankcase 56 is provided in front-rear symmetric relation to the rear mounting portion 413 of the crankcase 56.

The resin-made cover guide 392 has a peripheral wall 416 formed to extend along the outer periphery of the power generator 22, an outer peripheral protruding portion 417 protruding substantially radially outwardly from upper and front and rear regions of an inner edge portion 416*a* of the peripheral wall 416, and a seal attaching portion 418 for attaching the elastic sealing member 215 to the outer peripheral protruding portion 417.

In the cover guide 392, an outer edge portion 416*b* of the peripheral wall 416 is formed to abut against an inner edge portion 396*a* of the peripheral wall 396 of the fan cover 391 (see also FIG. 3). The outer peripheral protruding portion 417 projects substantially radially outwardly from upper, rear and front regions of the inner edge portion 416*a*.

The seal attaching portion 418 is provided on and along the outer peripheral edge of the protruding portion 417 and on a lower region of the inner edge portion 416*a*. The elastic sealing member 215 is mounted on and along the seal attaching portion 418 (see also FIG. 5).

The upper middle portion 417*a* of the protruding portion 417 is fastened by the bolt 412 together with the distal end portion 406*b* of the first supporting leg portion 406. The rear lower portion 417*b* of the protruding portion 417 is fastened by the bolt 412 together with the distal end portion 407*b* of the second supporting leg portion 407. Further, the front lower portion 417*c* of the protruding portion 417 is fastened by the bolt 412 together with the distal end portion 408*b* of the third supporting leg portion 408.

In the aforementioned state, the cover guide 392 is interposed between the fan cover 391 and the engine 21, and the outer edge portion 416*b* of the peripheral wall 416 overlaps the inner edge portion 396*a* of the fan cover 391 (peripheral wall 396) of the fan cover 391 in abutting relation to the inner edge portion 396*a*.

With the aforementioned arrangements, the cooling air sent from the cooling fan 85 can be directed to the engine 21 via the fan cover 391 and cover guide 392 as indicated by the arrow 134 in FIG. 5.

As set forth above in relation to FIGS. 9 and 10, the cooling fan 85 is covered with the metal fan cover 391, and the fan cover 391 has the first to third supporting leg portions 406-408 extending to the engine 21. Further, the resin-made cover guide 392 is fastened to the engine 21 together with the first to third supporting leg portions 406-408, and the lower cover 25 is supported by the metal fan cover 391 via the mounting members 33.

Thus, the weight of the engine/power generator unit 12 (i.e., weights of the engine 21 and power generator 22) can be supported by the first to third supporting leg portions 406-408 and metal fan cover 391 rather than by the resin-made cover guide 392. Because it is not necessary to support the weight of the engine/power generator unit 12 by the resin-made cover guide 392, the cover guide 392 can present a sufficient rigidity even if it is formed of resin.

Namely, with the resin-made cover guide 392 interposed between the metal fan cover 391 and the engine 21, the engine-driven power generator apparatus 10 can be reduced in weight. Further, the cooling air sent from the cooling fan 85 can be efficiently directed to the engine 21 via the fan cover 391 and cover guide 392 to thereby cool the engine 21 with an enhanced efficiency.

As shown in FIGS. 9 and 10, the elastic sealing member 215 is, for example, an elastically-deformable sealing member formed of ethylene propylene rubber (EPDM) in a substantially pentagonal frame shape. The elastic sealing member 215 has an engaging portion 215*a* along its inner periphery, and a lip (tongue) portion 215*b* along its outer periphery.

Further, the elastic sealing member 215 is attached at the engaging portion 215*a* to the seal attaching portion 418; namely, the elastic sealing member 215 is mounted on the outer periphery of the cover guide 392. Further, the elastic sealing member 215 is abutted against the inner surface 30 of the center frame member 27 and inner surfaces of the lower cover 25 and vertical frame member 26 with the lip portion 215*b* elastically deformed (see FIGS. 2 and 5).

Thus, the elastic sealing member 215 can prevent the cooling air, having been directed from the cover guide 392 to the engine 21, from flowing back from the engine 21 toward the cover guide 392. As a consequence, the cooling air sent from the cooling fan 85 can be efficiently directed to the engine 21 so that the engine 21 can be efficiently cooled with the directed cooling air.

Furthermore, as shown in FIG. 6, the elastic sealing member 215 has a harness clamp 409 provided on a rear end region 215*d* of the engaging portion 215*a*. The harness clamp 409 projects from the rear end region 215*d* toward the hot area 54. High tension cord (plug code) 410 is engaged by the harness clamp 409, and it has an ignition plug (spark plug) 419 (FIG. 11) connected to the upper end thereof and an ignition coil 420 connected to the lower end thereof. Because the harness clamp 409 is provided integrally on the elastic sealing member 215, it is possible to reduce the number of necessary component parts.

Furthermore, as shown in FIG. 5, the elastic sealing member 215 is provided between the center frame member 27 and the engine/power generator unit 12 and partitions the unit accommodating area 51 into the hot area 54 where the engine 21 is located and the cool area 53 where the power generator 22 is located.

Figure 11:
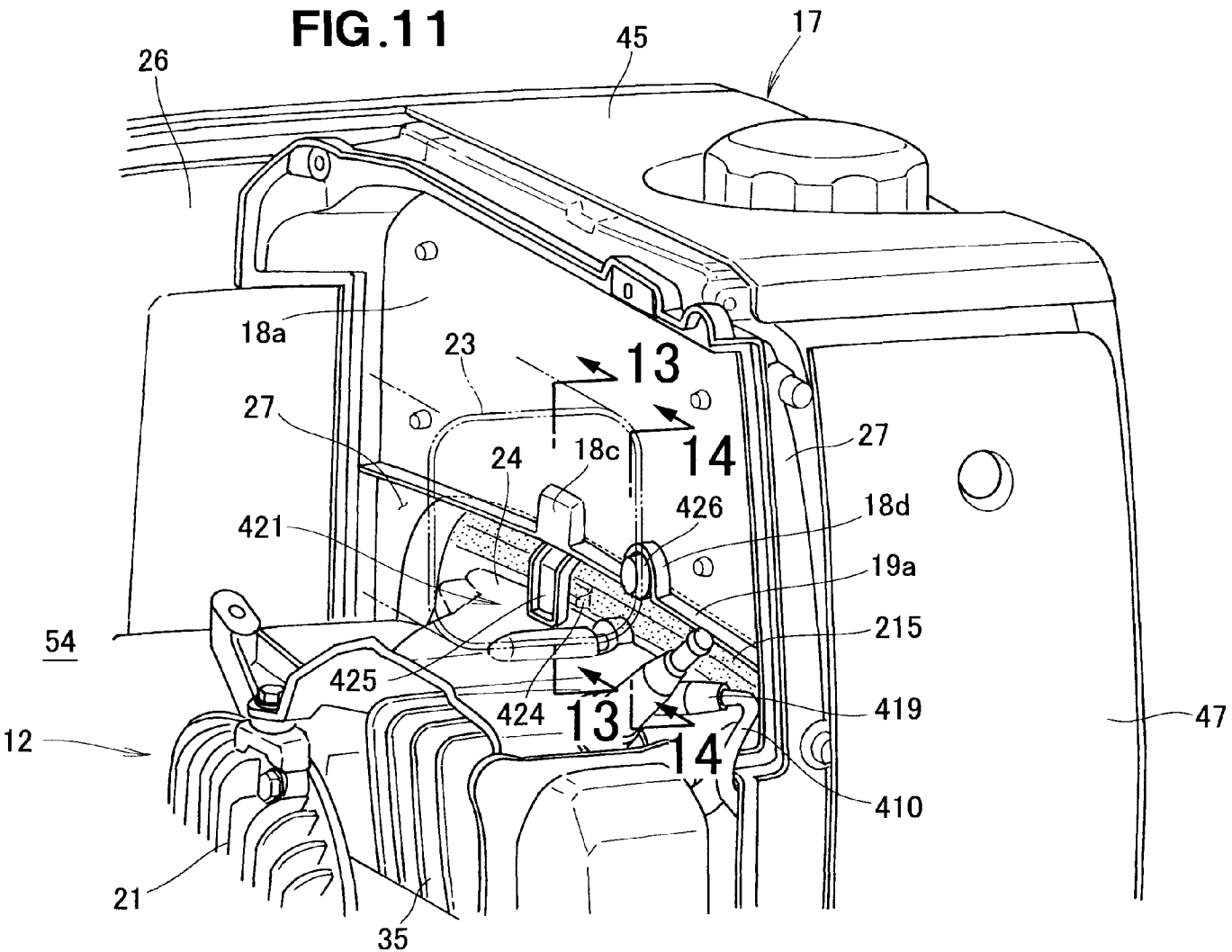
FIG. 11 is a perspective view of a vibration suppression section for suppressing vibration of the engine/power generator unit.
Figure 12:
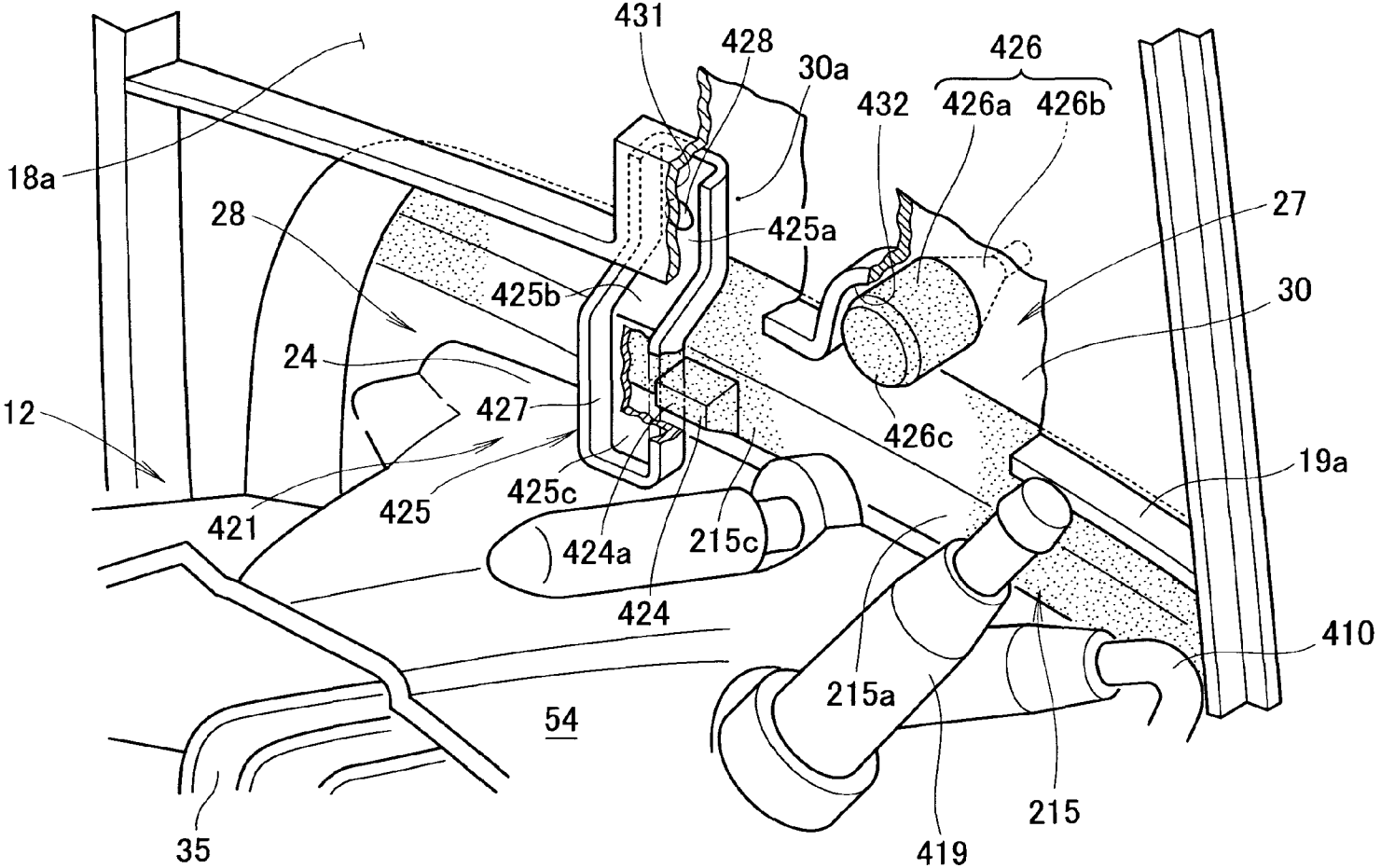
FIG. 12 is an enlarged perspective view of the vibration suppression section of FIG. 11.

FIG. 11 is a perspective view of the vibration suppression section 28 for suppressing vibration of the engine/power generator unit 12, and FIG. 12 is an enlarged perspective view of the vibration suppression section 28. The vibration suppression section 28 includes an upper vibration suppression section 421 provided over the engine/power generator unit 12, and a lower vibration suppression section 422 (FIG. 9) provided under the engine/power generator unit 12. In FIGS. 11 and 12, only a support panel 18*a* for supporting the heat insulating member 18 is illustrated with illustration of a heat insulating material 18*b* omitted for ease of understanding of the upper vibration suppression section 421.

The following describe the upper vibration suppression section 421. The upper vibration suppression section 421 includes an upper center bump stopper 424 formed integrally with the elastic sealing member 215, an upper center bump receiving section 425 which the center bump stopper 424 can abut against, and a muffler bump stopper 426 provided on the center frame member 27.

More specifically, the center bump stopper 424 is a projection formed integrally with an upper middle region 215*c* of the engaging portion 215*a* of the elastic sealing member 215 and projecting from the upper middle region 215*c* toward the hot area 54. The center bump stopper 424 is of a substantially rectangular parallelepiped shape and has a flat distal end surface 424*a*.

Because the center bump stopper 424 is formed integrally with the elastic sealing member 215, it is possible to reduce the number of necessary components and thus reduce the number of necessary steps for making the center bump stopper 424. As a result, the instant embodiment can achieve an enhanced productivity.

Further, the elastic sealing member 215 is provided between the center frame member 27 and the engine/power generator unit 12 (see also FIG. 5), and the center frame member 27 is disposed over the central portion 24 of the engine/power generator unit 12. Thus, with the center bump stopper 424 formed integrally with the upper middle region

215*c* of the elastic sealing member 215, the center bump stopper 424 can be located over the central portion 24 of the engine/power generator unit 12.

The engine/power generator unit 12 has its center of gravity G located substantially centrally thereof, as shown in FIGS. 2 and 5. The engine/power generator unit 12 vibrates about the center of gravity G, and thus, it is possible to suppress an amount of vibration of the center bump stopper 424 provided close to the center of gravity G. Thus, it is possible to reduce a load imposed on the center bump stopper 424 due to the vibration of the stopper 424. As a result, the instant embodiment can effectively suppress vibration of the center bump stopper 424 while permitting reduction of the size of the center bump stopper 424, thereby reducing the size of the engine-driven power generator apparatus 10.

Figure 13:
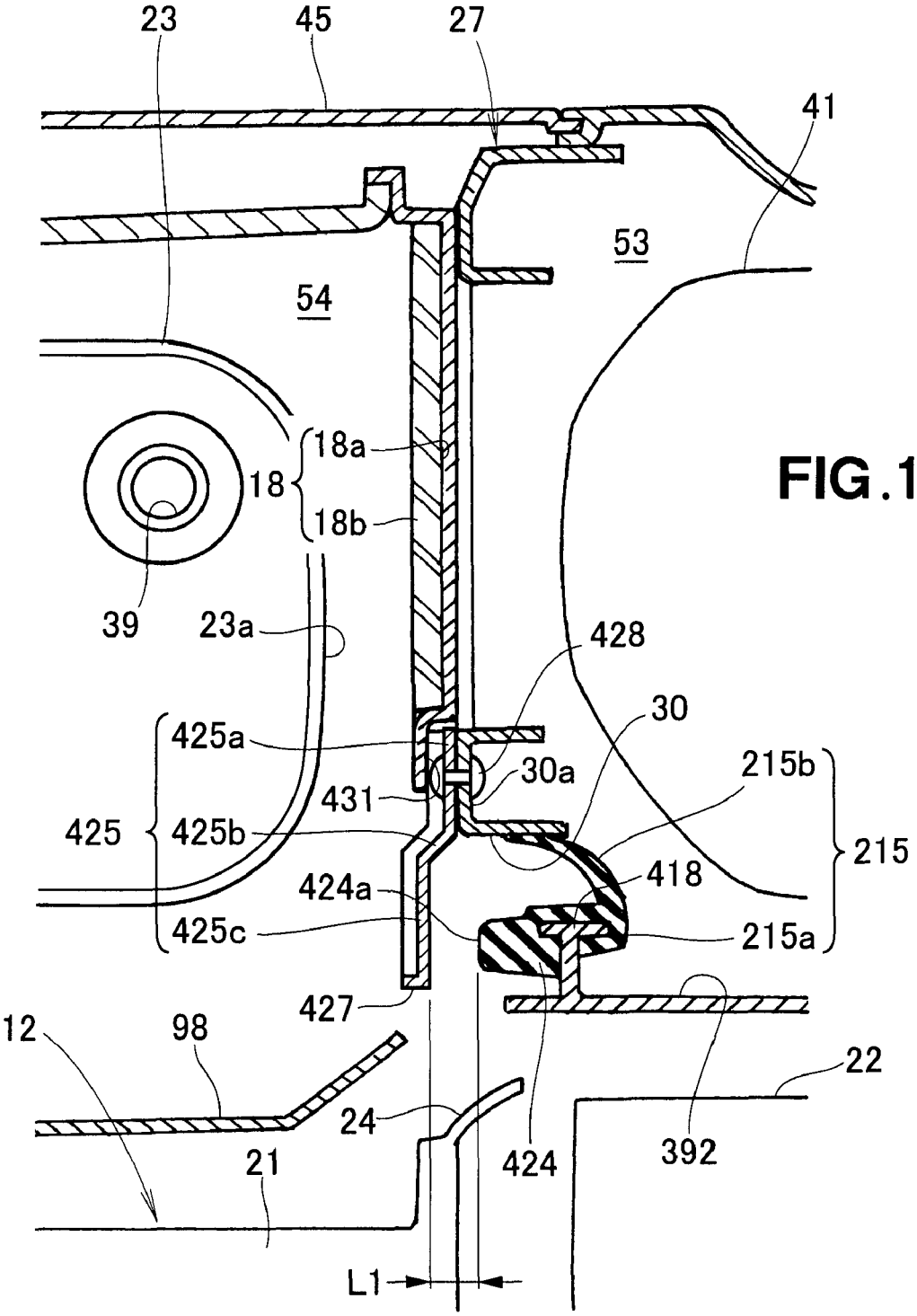
FIG. 13 is a sectional view taken along the 13-13 of FIG. 11.

FIG. 13 is a sectional view taken along the 13-13 of FIG. 11. The upper center bump receiving section 425 is, for example, a member formed by bending a flat plate of a substantially rectangular shape. More specifically, the upper center bump receiving section 425 has an upper half portion 425*a* fastened to a low middle portion 30*a* of the center frame member 27 by means of a fastener member 28, such as a rivet, a vertically middle portion 425*b* formed by being bent from the lower end of the upper half portion 425*a* toward the hot area 54, a lower half portion 425*c* formed by being bent downward from the lower end of the middle portion 425*b*, and a reinforcing rib 427 formed along the peripheral edge of the bump receiving section 425 (see also FIG. 12).

Because there is a need to prevent the upper half portion 425*a* of the upper center bump receiving section 425 from interfering with the heat-insulating-member support panel 18*a*, the support panel 18*a* has a lower middle portion 18*c* projecting toward the hot area 54 (see FIGS. 11 and 12), and a hollow portion 431 is formed in a position opposed to the upper half portion 425*a*. The upper half portion 425*a* of the upper center bump receiving section 425 is accommodated in the hollow portion 431, so that the center bump receiving section 425 can be prevented from interfering with the heat-insulating-member support panel 18*a*.

The lower half portion 425*c* is opposed to the distal end surface 424*a* of the center bump stopper 424 with a predetermined interval L1 from the distal end surface 424*a*. The predetermined interval L1 is set such that the center bump stopper 424 can abut against the lower half portion 425*c* when the engine/power generator unit 12 vibrates, more specifically such that a horizontal component of the vibration of the engine/power generator unit 12 allows the center bump stopper 424 to abut against the lower half portion 425*c*. Note that the predetermined interval L1 is adjustable by changing the bent condition of the middle portion 425*b* of the center bump receiving section 425.

Referring back to FIG. 12, the muffler bump stopper 426 has a stopper body 426*a* projecting into the hot area 54 from a rear region of the center bump receiving section 425 (low middle portion 30*a* of the center frame member 27), and a clip portion 426*b* provided at a proximal end portion of the stopper body 426*a*. The stopper body 426*a* is a projection formed of elastically deformable rubber in a substantially circular sectional shape and having a flat distal end surface 426*c*.

Because there is a need to prevent the stopper body 426*a* of the muffler bump stopper 426 from interfering with the heat-insulating-member support panel 18*a*, the support panel 18*a* has a lower middle portion 18*d* arcuately curved or projecting upward (see FIG. 11) to provide a hollow portion 432 in a position opposed to the stopper body 426*a*. The stopper body 426*a* is accommodated in the hollow portion 432, so that the stopper body 426*a* can be prevented from interfering with the heat-insulating-member support panel 18*a*.

Figure 14:
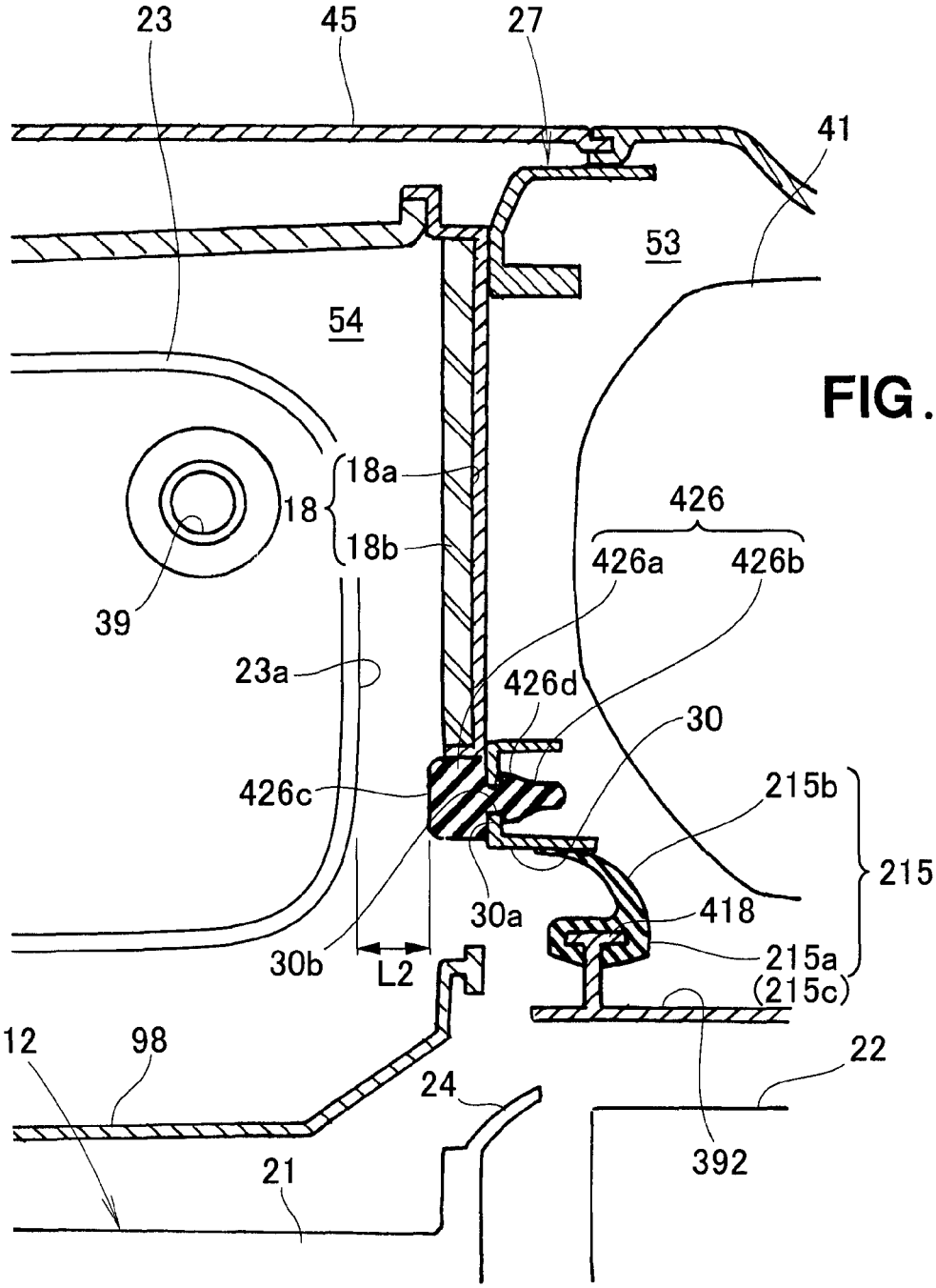
FIG. 14 is a sectional view taken along the 14-14 line of FIG. 11.

FIG. 14 is a sectional view taken along the 14-14 line of FIG. 11. The clip portion 426*b* of the muffler bump stopper 426 is a fastening portion for fastening the muffler bump stopper 426 to the center frame member 27. Namely, the muffler bump stopper 426 is fastened to the low middle portion 30*a* of the center frame member 27 with the clip portion 426*b* inserted through a locking hole 30*b* so that an engaging bulge 426*d* of the clip portion 426*b* engages the peripheral edge of the locking hole 30*b*.

In the aforementioned manner, the muffler bump stopper 426 is located over the central portion 24 of the engine/power generator unit 12 as seen in FIGS. 11 and 12.

The stopper body 426*a* is opposed to an inner side wall 23*a* of the muffler 23 with a predetermined interval L2 from the wall 23*a*. The predetermined interval L2 is set such that the inner side wall 23*a* of the muffler 23 can abut against the muffler bump stopper 426 (flat distal end surface 426*c* of the stopper body 426*a*) when the engine/power generator unit 12 vibrates, more specifically such that a horizontal component of the vibration of the engine/power generator unit 12 allows the inner side wall 23*a* of the muffler bump stopper 426 to abut against the flat distal end surface 426*c* of the stopper body 426*a*.

Because the muffler bump stopper 426 is disposed over the central portion 24 of the engine/power generator unit 12, it can be located close to the center of gravity G of the engine/power generator unit 12 (see FIGS. 2 and 5). Thus, an amount of vibration of the muffler bump stopper 426 can be kept small similarly to that of the upper center bump stopper 424. Consequently, it is possible to reduce a load imposed on the muffler bump stopper 426 due to the vibration of the stopper 426. As a result, the instant embodiment can effectively suppress vibration of the muffler bump stopper 426 while permitting reduction of the size of the stopper 426, thereby reducing the size of the engine-driven power generator apparatus 10.

The following describe the lower vibration suppression section 422. Referring back to FIG. 9, the lower vibration suppression section 422 includes a lower center bump stopper 435 provided on the right reinforcing rib 149 of the lower cover 25, a lower center bump receiving section 436 (see FIG. 15) (or a bottom portion of the engine/power generator unit 12) against which the center bump stopper 435 can abut, and a lower front bump stopper 437 and lower rear bump stopper 438 provided on the left reinforcing rib 148 of the lower cover 25.

More specifically, the lower center bump stopper 435 has a stopper support portion 441 provided on a substantial middle region of the right reinforcing rib 149, and a stopper body 442 provided on the stopper support portion 441. The stopper body 442 is a projection that is formed of elastically deformable rubber in a substantially oval sectional shape and that projects upward from the stopper support portion 441. The stopper body 442 has a flat upper end surface 442*a*.

Figure 15:
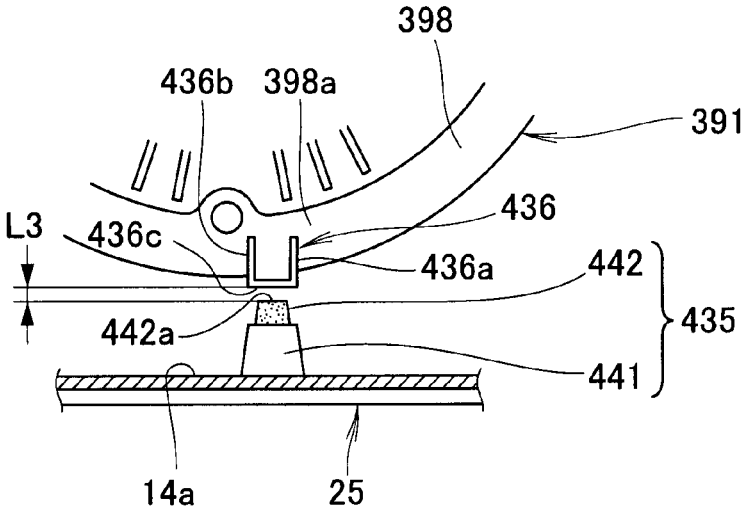
FIG. 15 is a side view showing a lower center bump stopper of the engine/power generator unit.

FIG. 15 is a side view showing the lower center bump stopper 435 of the engine/power generator unit 12. The lower center bump receiving section 436 is provided on a lower portion 398*a* of the outer wall 398 of the fan cover 391. The lower center bump receiving section 436 has front and rear wall portions 436*a* and 436*b* opposed to each other with a predetermined interval therebetween, and a bottom wall portion 436*c* interconnecting the respective lower ends of the front and rear wall portions 436*a* and 436*b*; namely, the lower center bump receiving section 436 is formed in a substantially U sectional shape with the wall portions 436*a* and 436*b* and 436*c*.

The bottom wall portion 436*c* of the lower center bump receiving section 436 is opposed to the flat upper end surface 442*a* with a predetermined interval L3 from the end surface 442*a*. The predetermined interval L3 is set such that the bottom wall portion 436*c* of the lower center bump receiving section 436 can abut against the lower center bump stopper 435 when the engine/power generator unit 12 vibrates, more specifically such that a vertical component of the vibration of the engine/power generator unit 12 allows the bottom wall portion 436*c* to abut against the lower center bump stopper 435.

Because the bottom wall portion 436*c* of the lower center bump receiving section 436 is provided on the outer wall 398 of the fan cover 391 and the outer wall 398 is located to the right of the engine/power generator unit 12, the bottom wall portion 436*c* is located at a relatively great distance from the center of gravity G (FIGS. 2 and 5). Therefore, an amount of vibration of the bottom wall portion 436*c* of the lower center bump receiving section 436 might become great.

However, in the instant embodiment, where the vibration of the engine/power generator unit 12 can be effectively suppressed, it is possible to suppress the amount of vibration of the bottom wall portion 436*c*. Thus, the instant embodiment can sufficiently suppress the vibration of the bottom wall portion 436*c* of the lower center bump receiving section 436 even if the lower center bump stopper 435 is reduced in size.

FIG. 16 is a side view showing the lower front bump stopper 437 and lower rear bump stopper 438 of the engine/power generator unit 12. The lower front bump stopper 437 has a front stopper support portion 444 provided on the left reinforcing rib 148 near the front end of the rib 148, and a front stopper body 445 that is a projection provided on the front stopper support portion 444 and projecting upward from the stopper support portion 444.

For example, the front stopper body 445 is formed of elastically deformable rubber integrally with the projecting guide portion 225. The projecting guide portion 225 directs the cooling air, sent from the cooling fan 85 (FIG. 5), as indicated by the white arrow 135 in FIG. 9, so that the cooling air can be directed to the cylinder block 35 along the lower cover 25.

The front stopper body 445 is opposed to the head 401*a* of the bolt 401 (or the bottom of the engine/power generator unit 12). The bolt 401 is a member for fastening the mounting member 33 to the front mounting portion 414 on the bottom portion 56*a* of the crankcase 56.

The front stopper body 445 has a flat upper end surface 445*a* located at a predetermined interval L4 from the head 401*a* of the bolt 401. The predetermined interval L4 is set such that the bolt head 40 la can abut against the lower front bump stopper 437 when the engine/power generator unit 12 vibrates, more specifically such that a vertical component of the vibration of the engine/power generator unit 12 allows the bolt head 401*a* to abut against the lower front bump stopper 437.

The head 401*a* of the bolt 401, inserted through the front mounting portion 414, is located on the outer surface of the bottom portion 56*a* of the crankcase 56, and the outer surface of the bottom portion 56*a* of the crankcase 56 is located to the left of the engine/power generator unit 12. Thus, the bolt head 401*a* is located at a relatively great distance from the center of gravity G (FIGS. 2 and 5). Therefore, an amount of vibration of the bolt head 401*a* inserted through the front mounting portion 414 might become great.

However, in the instant embodiment, where the vibration of the engine/power generator unit 12 can be effectively suppressed by the upper vibration suppression section 421, it is possible to suppress the amount of vibration of the bolt 401 (head 401*a*). As a result, the instant embodiment can sufficiently suppress the vibration of the bolt 401 (head 401*a*) even if the lower front bump stopper 437 is reduced in size.

Further, the lower rear bump stopper 438 is provided in front-rear symmetric relation to the lower front bump stopper 437. Namely, the lower rear bump stopper 438 has a rear stopper support portion 446 provided on the left reinforcing rib 148 near the rear end of the rib 148, and a rear stopper body 447 provided on the rear stopper support portion 446.

The rear stopper body 447 is a projection that projects upward from the rear stopper support portion 446 and has a flat upper end surface 447*a*. For example, the rear stopper body 447 is formed of elastically deformable rubber integrally with the projecting guide portion 225. The rear stopper body 447 is opposed to the head 401*a* of the bolt 401 (or the bottom of the engine/power generator unit 12). The bolt 401 is a member for fastening the mounting member 33 to the rear mounting portion 415 on the bottom portion 56*a* of the crankcase 56.

The flat upper end surface 447*a* of the stopper body 447 is located at a predetermined interval L4 from the head 401*a* of the bolt 401. The predetermined interval L4 is set such that the bolt head 401*a* can abut against the lower rear bump stopper 438 when the engine/power generator unit 12 vibrates, more specifically such that a vertical component of the vibration of the engine/power generator unit 12 allows the bolt head 401*a* to abut against the rear bump stopper 438.

The head 401*a* of the bolt 401, inserted through the rear mounting portion 415, is located on the outer surface of the bottom portion 56*a* of the crankcase 56, and the outer surface of the bottom portion 56*a* of the crankcase 56 is located to the left of the engine/power generator unit 12. Thus, the bolt head 401*a* is located at a relatively great distance from the center of gravity G (FIGS. 2 and 5). Therefore, an amount of vibration of the bolt head 401*a* inserted through the rear mounting portion 415 might become great.

However, in the instant embodiment, where the vibration of the engine/power generator unit 12 can be effectively suppressed by the upper vibration suppression section 421, it is possible to suppress the amount of vibration of the bolt 401 (head 401*a*). As a result, the instant embodiment can sufficiently suppress the vibration of the bolt 401 (head 401*a*) even if the lower rear bump stopper 438 is reduced in size.

With reference to FIGS. 17 and 18, the following describe how vibration of the engine/power generator unit 12 is suppressed by the vibration suppression section 28 in the instant embodiment.

Figure 17A:
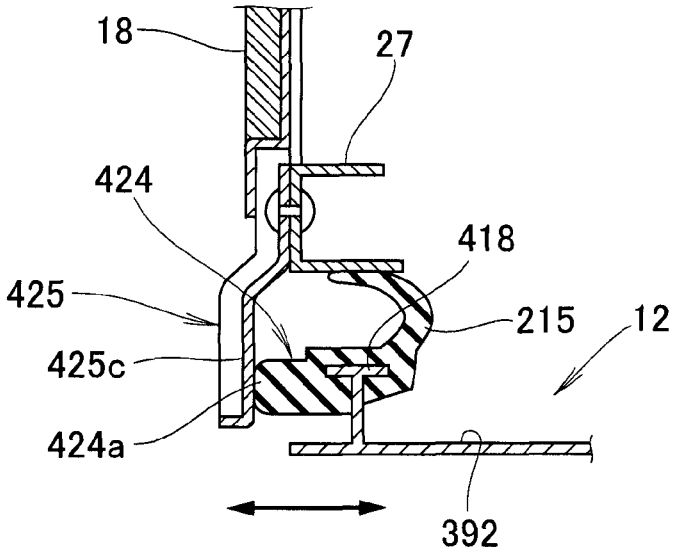
FIGS. 17A and 17B are views explanatory of an example manner in which vibration of the engine/power generator unit is suppressed by an upper vibration suppression section.
Figure 17B:
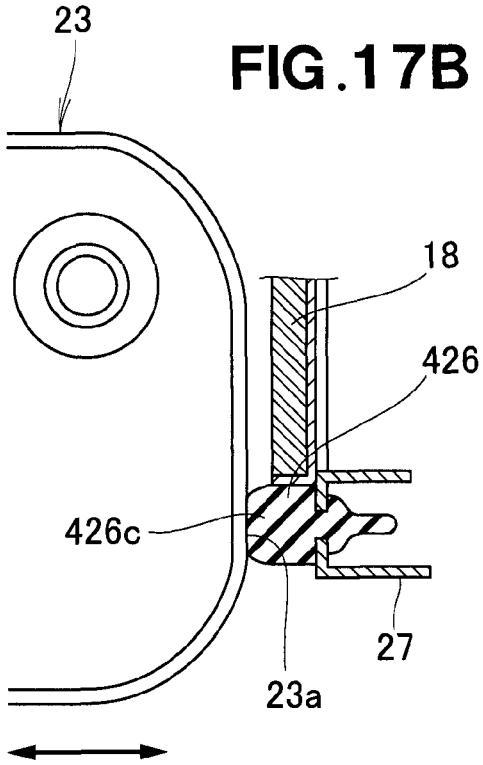

FIGS. 17A and 17B are views explanatory of an example manner in which vibration of the engine/power generator unit 12 is suppressed by the upper vibration suppression section 421. As shown in FIG. 17A, the upper center bump stopper 424 vibrates about the center of gravity G as the engine/power generator unit 12 vibrates about the center of gravity G. During that time, a horizontal component of the vibration (i.e., component indicated by a horizontal double-head arrow) causes the upper center bump stopper 424 to vibrate in the direction of the arrow (i.e., in the horizontal direction). Thus, the horizontal component of the vibration causes the upper center bump stopper 424 to abut against the lower half portion 425*c* of the upper center bump receiving section 425. Thus, the horizontal component of the vibration is suppressed, which suppresses the vibration of the engine/power generator unit 12.

Further, as shown in FIG. 17B, the muffler 23 vibrates about the center of gravity G as the engine/power generator unit 12 vibrates about the center of gravity G, during which time a horizontal component of the vibration (i.e., component indicated by a horizontal double-head arrow) causes the muffler 23 to vibrate in the direction of the arrow (i.e., in the horizontal direction). Thus, the horizontal component of the vibration causes the inner side wall 23*a* of the muffler 23 to abut against the distal end surface 426*c* of the stopper body 426*a*. Thus, the horizontal component of the vibration is suppressed, which suppresses the vibration of the engine/power generator unit 12.

Figure 18A:
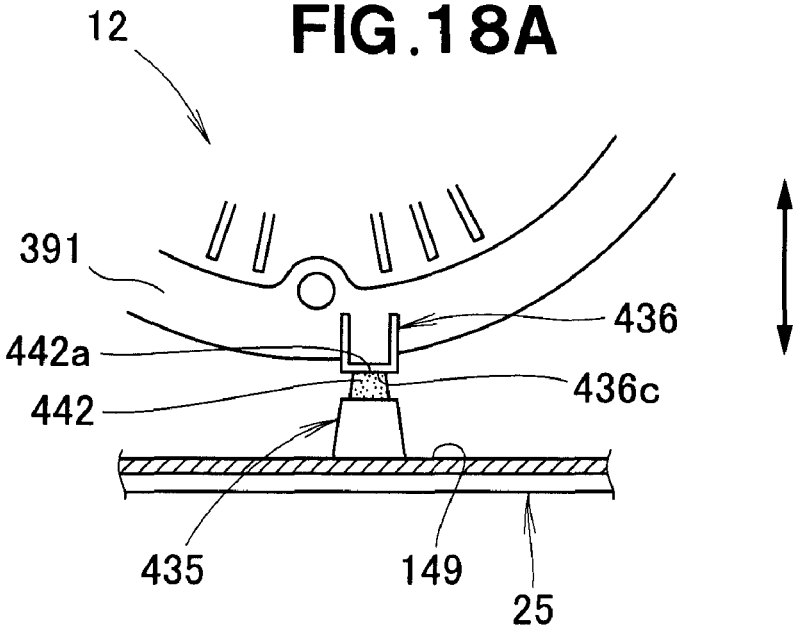
FIGS. 18A and 18B are views explanatory of an example manner in which vibration of the engine/power generator unit is suppressed by a lower upper vibration suppression section.
Figure 18B:
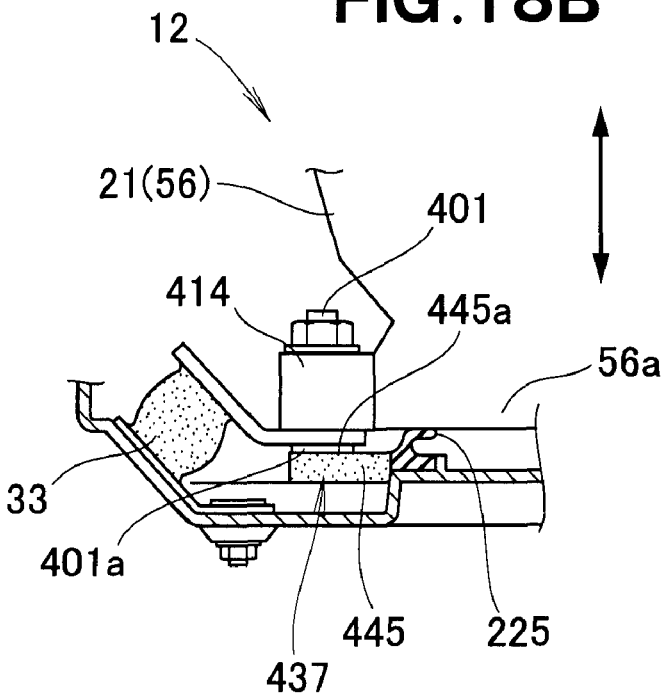

FIGS. 18A and 18B are views explanatory of an example manner in which vibration of the engine/power generator unit 12 is suppressed by the lower vibration suppression section 422. As shown in FIG. 18A, the lower center bump receiving section 436 vibrates about the center of gravity G together with the fan cover 391 as the engine/power generator unit 12 vibrates about the center of gravity G. During that time, a vertical component of the vibration (i.e., component indicated by a vertical double-head arrow) causes the lower center bump receiving section 436 to vibrate in the direction of the arrow (i.e., in the vertical direction) together with the fan cover 391. Thus, the vertical component of the vibration causes the bottom wall portion 436*c* of the lower center bump receiving section 436 to abut against the upper end surface 442*a* of the lower center bump stopper 435. Thus, the vertical component of the vibration is suppressed, which suppresses the vibration of the engine/power generator unit 12.

As shown in FIG. 18B, the bottom portion 56*a* of the crankcase 56 vibrates about the center of gravity G as the engine/power generator unit 12 vibrates about the center of gravity G. During that time, a vertical component of the vibration (i.e., component indicated by a vertical double-head arrow) causes the bolt head 401*a* to vibrate in the direction of the vertical double-head arrow together with the front mounting portion 414 of the bottom portion 56*a*.

Thus, the vertical component of the vibration causes the bolt head 401*a* to abut against the upper end surface 445*a* of the lower front bump stopper 437. Thus, the vertical component of the vibration is suppressed, which suppresses the vibration of the engine/power generator unit 12.

The lower rear bump stopper 438 is provided in front-rear symmetric relation to the lower front bump stopper 437 and can suppress vibration in a similar manner to the lower front bump stopper 437.

Further, because the elastic sealing member 215 is abutted against the inner surface 30 of the center frame member 27 and inner surfaces of the lower cover 25 and vertical frame member 26 with the lip portion 215*b* elastically deformed as shown in FIG. 2, vertical vibration of the engine/power generator unit 12 can be suppressed by upper and lower portions of the elastic sealing member 215, while horizontal vibration of the engine/power generator unit 12 can be suppressed by front and rear portions of the elastic sealing member 215. Namely, the elastic sealing member 215 functions as a vibration deadening member.

Whereas the preferred embodiment has been described in relation to the case where the left and right wheels 31 and 32 are provided on the rear end region 25*b* of the lower cover 25 and the left and right leg portions 29 are provided on the front end region 25*a* of the lower cover 25, the present invention is not so limited. For example, wheels may be provided on the front end region 25*a* of the lower cover 25 in place of the leg portions 29.

Further, whereas the preferred embodiment has been described as including the first to third supporting leg portions 406-408, the present invention is not so limited, and it may include less than or more than three, such as four, supporting leg portions.

Further, whereas the preferred embodiment has been described in relation to the case where the metal fan cover 391 is made of aluminum, the metal fan cover 391 is made of any other suitable metal.

Furthermore, the shapes and constructions of the mounting members 33, elastic sealing member 215, fan cover 391, cover guide 392, first to third supporting leg portions 406-408, etc. are not limited to those illustratively shown and described herein, and they may be modified as necessary.

The present invention is well suited for application to engine-driven power generator apparatus where an engine-driven power generator is accommodated in a case along with the engine, and where the engine is fixedly supported by a lower cover via mounting members.

Obviously, various minor changes and modifications of the present invention are possible in light of the above teaching. It is therefore to be understood that within the scope of the appended claims the invention may be practiced otherwise than as specifically described.

What is claimed is:

1. An engine-driven power generator apparatus comprising:

a power generator;

an engine for driving the power generator, the engine having a cylinder block;

a cooling fan connected to a drive shaft of the engine;

a lower cover supporting the engine;

a case disposed over the lower cover and having the engine and the cooling fan accommodated therein;

a first cooling structure for cooling the engine; and a second cooling structure for cooling the case, wherein the case includes a left side case section formed with a left side wall portion and a left upper wall portion, a right side case section formed with a right side wall portion and a right upper wall portion, a front wall portion mounted to respective front ends of the left and right side wall portions, and a rear wall portion mounted to respective rear ends of the left and right side wall portions, the case being formed in a substantially rectangular parallelepiped shape with the left and right side wall portions and front and rear wall portions, the left and right upper wall portions together forming an upper wall portion of the case, wherein the cooling fan is disposed in opposed relation to the side wall portion of one of the left and right side case sections, wherein one of the front and rear wall portions has a first inlet port formed therein for introducing cooling air into the case, and other of the front and rear wall portions has an outlet port formed therein for discharging the cooling air from the case, wherein the lower cover has a second inlet port formed therein for introducing cooling air into the case, wherein the first cooling structure includes an engine shroud disposed over the cylinder block of the engine with a predetermined gap therefrom, and a cylinder cooling flow passage defined between the cylinder block and the engine shroud, the cylinder cooling flow passage being in communication with the first inlet port, wherein the second cooling structure includes a case shroud disposed a predetermined distance from an inner surface of the other of the left and right side case sections, and a case cooling flow passage defined between the other side case section and the case shroud, the second case cooling flow passage being in communication with the second inlet port, wherein the first cooling structure directs the cooling air, introduced via the first inlet port into the case by operation of the cooling fan, to the cylinder cooling flow passage for guiding the cooling air along the cylinder block of the engine to cool the cylinder block, further directs the cooling air, having cooled the cylinder block, in a meandering fashion, and discharges the cooling air out of the case via the outlet port, and wherein the second cooling structure directs the cooling air, introduced via the second inlet port into the case by the operation of the cooling fan, to the case cooling flow passage for guiding the cooling air successively along the other side case section and the one side case section to thereby cool the other side case section and the one side case section, further directs the cooling air, having cooled the case, into the cooling fan, and discharges the cooling air through the outlet port.

2. An engine-driven power generator apparatus comprising:

a power generator;

an engine for driving the power generator;

a cooling fan connected to a drive shaft of the engine;

a lower cover supporting the engine;

a case disposed over the lower cover and having the engine and the cooling fan accommodated therein;

a first cooling structure for directing cooling air, introduced into the case by operation of the cooling fan, to a cylinder block of the engine to cool the cylinder block and then discharging the cooling air, having cooled the cylinder block, out of the case along meandering flow passages; and a second cooling structure for directing cooling air, introduced into the case by the operation of the cooling fan, along an inner surface of the case to cool the case, wherein the case is formed in a substantially rectangular parallelepiped shape with left and right side wall portions and front and rear wall portions thereof, wherein the cooling fan is disposed in opposed relation to one of the left and right side wall portions, wherein the first cooling structure includes a first inlet port provided in one of the front and rear wall portions for introducing therethrough the cooling air into the case, first cooling flow passage means for cooling the cylinder block with the cooling air introduced through the first inlet port, and an outlet port provided in other of the front and rear wall portions for discharging therethrough the cooling air having cooled the cylinder block, and wherein the second cooling structure includes a second inlet port provided in the lower cover for introducing therethrough cooling air into the case along the inner surface of the case, and second cooling flow passage means for cooling the case with the cooling air introduced through the second inlet port and discharging the cooling air, having cooled the case, through the outlet port.

3. An engine-driven power generator apparatus comprising:

a power generator;

an engine for driving the power generator;

a cooling fan connected to a drive shaft of the engine;

a lower cover supporting the engine;

a case disposed over the lower cover and having the engine and the cooling fan accommodated therein;

a first cooling structure for directing cooling air, introduced into the case by operation of the cooling fan, to a cylinder block of the engine to cool the cylinder block and then discharging the cooling air, having cooled the cylinder block, out of the case along meandering flow passages; and a second cooling structure for directing cooling air, introduced into the case by the operation of the cooling fan, along an inner surface of the case to cool the case;

a heat radiating fin provided in a vertical orientation on a wall portion of a crankcase of the engine opposite from the cooling fan; and a further cooling flow passage defined by the lower cover and the crankcase for directing the cooling air to the heat radiating fin so that the cooling air flows upward along the heat radiating fin and then is discharged through the outlet port.

4. The engine-driven power generator apparatus of claim 3, wherein the further cooling flow passage includes a vertically-projecting guide section for directing the cooling air upward to the heat radiating fin along the crankcase.

5. An engine-driven power generator apparatus comprising:

a power generator;

an engine for driving the power generator;

a cooling fan connected to a drive shaft of the engine;

a lower cover supporting the engine;

a case disposed over the lower cover and having the engine and the cooling fan accommodated therein;

a first cooling structure for directing cooling air, introduced into the case by operation of the cooling fan, to a cylinder block of the engine to cool the cylinder block and then discharging the cooling air, having cooled the cylinder block, out of the case along meandering flow passages; and a second cooling structure for directing cooling air, introduced into the case by the operation of the cooling fan, along an inner surface of the case to cool the case, wherein the engine is supported by the lower cover via a mounting member, and wherein the engine-driven power generator apparatus further comprises:

a metal fan cover covering the cooling fan and supported by the lower cover via the mounting member;

a plurality of supporting leg portions provided on the fan cover and extending from the fan cover to the engine; and a resin-made cover guide fastened to the engine together with the plurality of supporting leg portions and interposed between the fan cover and the engine, the cover guide directing the cooling air, sent from the cooling fan, toward the engine.

6. The engine-driven power generator apparatus of claim 5, further comprising an elastic sealing member provided on and along an outer periphery of the resin-made cover guide for preventing the cooling air, having been directed from the cover guide to the engine, from flowing back from the engine toward the cover guide.

* * * * *